US010598349B2

(12) United States Patent
Du et al.

(10) Patent No.: US 10,598,349 B2
(45) Date of Patent: Mar. 24, 2020

(54) LIGHTING COMPONENT INCLUDING SWITCHABLE DIFFUSER

(71) Applicant: 3M INNOVATIVE PROPERTIES COMPANY, St. Paul, MN (US)

(72) Inventors: Guanglei Du, Woodbury, MN (US); John A. Wheatley, Lake Elmo, MN (US); Robert L. Brott, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 15/514,861

(22) PCT Filed: Oct. 22, 2015

(86) PCT No.: PCT/US2015/056806
§ 371 (c)(1),
(2) Date: Mar. 28, 2017

(87) PCT Pub. No.: WO2016/073207
PCT Pub. Date: May 12, 2016

(65) Prior Publication Data

US 2017/0241622 A1 Aug. 24, 2017

Related U.S. Application Data

(60) Provisional application No. 62/076,946, filed on Nov. 7, 2014.

(51) Int. Cl.
*F21V 14/00* (2018.01)
*F21V 3/00* (2015.01)
(Continued)

(52) U.S. Cl.
CPC ..... *F21V 14/003* (2013.01); *F21K 9/69* (2016.08); *F21V 3/00* (2013.01); *F21V 5/04* (2013.01); *F21V 7/22* (2013.01); *F21Y 2115/10* (2016.08)

(58) Field of Classification Search
CPC . F21V 14/003; F21V 7/22; F21V 5/04; F21V 3/00; F21K 9/69
See application file for complete search history.

(56) References Cited

U.S. PATENT DOCUMENTS 4,893,117 A 1/1990 Blomley
4,985,816 A * 1/1991 Seko ..... B60Q 1/0023 362/303
(Continued)

FOREIGN PATENT DOCUMENTS

EP 2331869 4/2015
EP 1979672 9/2017
(Continued)

OTHER PUBLICATIONS

Walker, "Structured surfaces for active daylighting", National Physical Laboratory, 2013, pp. 1-18.
(Continued)

*Primary Examiner* — Arman B Fallahkhair
(74) *Attorney, Agent, or Firm* — Clifton F. Richardson

(57) ABSTRACT

A lighting component including an optical volume and a switchable diffuser disposed at least partially within the optical volume is described. The optical volume includes a light injection region, at least one reflective or transflective outer major surface, and an output major surface. The at least one reflective or transflective outer major surface defines opposing boundaries of the optical volume. The output major surface is adjacent one or more distal edges of the at least one reflective or transflective outer major surface. The switchable diffuser has at least a first state and a second
(Continued)

state. The switchable diffuser may have a surface normal that is not parallel to an optical axis of the optical volume. The at least one reflective or transflective outer major surface may have a spatially varying reflective property.

13 Claims, 23 Drawing Sheets

(51) Int. Cl.

| | |
|---|---|
| ***F21V 5/04*** | (2006.01) |
| ***F21K 9/69*** | (2016.01) |
| ***F21V 7/22*** | (2018.01) |
| *F21Y 115/10* | (2016.01) |

(56) References Cited

U.S. PATENT DOCUMENTS

| | | | | |
|---|---|---|---|---|
| 5,416,318 | A | 5/1995 | Hegyi | |
| 5,882,774 | A | 3/1999 | Jonza | |
| 6,179,948 | B1 | 1/2001 | Merrill | |
| 6,783,349 | B2 | 8/2004 | Neavin | |
| 6,890,642 | B2 | 5/2005 | Kaminsky | |
| 7,040,774 | B2 * | 5/2006 | Beeson | G02B 19/0019 362/257 |
| 7,114,834 | B2 * | 10/2006 | Rivas | F21V 3/02 362/373 |
| 7,273,640 | B2 | 9/2007 | Laney | |
| 8,042,967 | B2 * | 10/2011 | Hikmet | F21V 5/00 362/200 |
| 8,235,547 | B2 | 8/2012 | Hofmann | |
| 8,300,304 | B2 | 10/2012 | Gally | |
| 8,427,605 | B2 * | 4/2013 | Boonekamp | C09K 11/0883 349/86 |
| 8,556,459 | B2 | 10/2013 | Takamura et al. | |
| 8,750,671 | B1 * | 6/2014 | Kelly | F21V 3/049 362/335 |
| 8,920,001 | B2 | 12/2014 | Park | |
| 9,328,899 | B2 * | 5/2016 | Kataoka | F21S 8/04 |
| 9,841,167 | B2 * | 12/2017 | Benner | F21V 23/0435 |
| 2003/0133284 | A1 | 7/2003 | Chipchase | |
| 2003/0185011 | A1 | 10/2003 | Strazzanti | |
| 2005/0259193 | A1 | 11/2005 | Sumiyoshi | |
| 2006/0250541 | A1 | 11/2006 | Huck | |
| 2006/0256244 | A1 | 11/2006 | Jak | |
| 2012/0038990 | A1 | 2/2012 | Hao | |
| 2012/0169953 | A1 | 7/2012 | Kataoka et al. | |
| 2014/0132883 | A1 | 5/2014 | Roberts et al. | |

FOREIGN PATENT DOCUMENTS

| | | |
|---|---|---|
| JP | H0255337 | 2/1990 |
| JP | 2011197537 | 10/2011 |
| WO | 2006-043196 | 4/2006 |
| WO | 2009-022282 | 2/2009 |
| WO | 2011-083392 | 7/2011 |
| WO | 2013-156927 | 10/2013 |

OTHER PUBLICATIONS

International Search Report for PCT International Application No. PCT/US2015/056806, dated Mar. 10, 2016, 3 pages.

* cited by examiner

LIGHTING COMPONENT INCLUDING SWITCHABLE DIFFUSER

BACKGROUND

Lighting components may include a reflector to direct the light output of the lighting component. A diffuser may also be included to improve the uniformity of the light output. In some cases, it may be desirable to be able to electrically adjust the light output from a lighting component.

SUMMARY

In some aspects of the present description, a lighting component is provided that includes an optical volume and a switchable diffuser disposed at least partially within the optical volume. The optical volume includes a light injection region, at least one reflective or transflective outer major surface, and an output major surface. The output major surface is adjacent one or more distal edges of the at least one reflective or transflective outer major surface. The switchable diffuser has at least a first state and a second state where the first state is characterized by a first haze and the second state characterized by a second haze different from the first haze. At least a portion of the first switchable diffuser has a surface normal that is not parallel to an optical axis of the optical volume. The at least one reflective or transflective outer major surface defines opposing boundaries of the optical volume.

In some aspects of the present description, a lighting component is provided that includes an optical volume and a switchable diffuser disposed at least partially within the optical volume. The optical volume includes least one reflective or transflective outer major surface, a light injection region adjacent the at least one reflective or transflective outer major surface, and a distal surface opposite the light injection region. The switchable diffuser has at least a first state and a second state where the first state is characterized by a first haze and the second state characterized by a second haze different from the first haze. The at least one reflective or transflective outer major surface has a spatially varying reflective property and the at least one reflective or transflective outer major surface defines opposing boundaries of the optical volume.

In some aspects of the present description, a lighting component is provided that includes an optical volume and a switchable diffuser disposed at least partially within the optical volume. The optical volume includes at least one reflective or transflective outer major surface, a light injection region adjacent the at least one reflective or transflective outer major surface, and a distal surface opposite the light injection region. The switchable diffuser has at least a first state and a second state where the first state is characterized by a first haze and the second state characterized by a second haze different from the first haze. The at least one reflective or transflective outer major surface includes one or more surfaces extending from the light injection region to the output major surface, and includes an additional surface disposed proximate the output major surface opposite the light injection region.

In some aspects of the present description, a lighting component is provided that includes a monolithic optically clear component having at least one sloping major surface, and at least one diffuser attached to and covering at least a portion of at least one sloping major surface. The monolithic optically clear component includes an input surface adjacent the at least one sloping major surface, and an output surface opposite the input surface where the output surface is adjacent the at least one sloping major surface. The at least one diffuser includes a first electrically switchable diffuser having at least a first state and a second state different from the first state. The at least one sloping major surface substantially converge or diverge but not both from the input surface to the output surface.

In some aspects of the present description, a lighting component is provided that includes a light guide having at least one major surface, an input surface adjacent the at least one major surface, and an output surface opposite the input surface. The output surface is adjacent to the at least one major surface. A first switchable diffuser is disposed adjacent the input surface opposite the output surface. The first switchable diffuser has at least a first state and a second state different from the first state.

In some aspects of the present description, a lighting component is provided that includes an optical volume having at least one reflective or transflective outer major surface, a light injection region adjacent the at least one reflective or transflective outer major surface, and a distal surface opposite the light injection region, and a switchable diffuser disposed at least partially within the optical volume. The switchable diffuser has at least a first state and a second state where the first state characterized by a first haze and the second state characterized by a second haze different from the first haze. The at least one reflective or transflective outer major surface defines opposing boundaries of the optical volume. The opposing boundaries substantially converge from the light injection region to the distal surface.

BRIEF DESCRIPTION OF THE DRAWINGS

FIGS. 8-12A are cross-sectional views of lighting components;

DETAILED DESCRIPTION

Figure 1A:
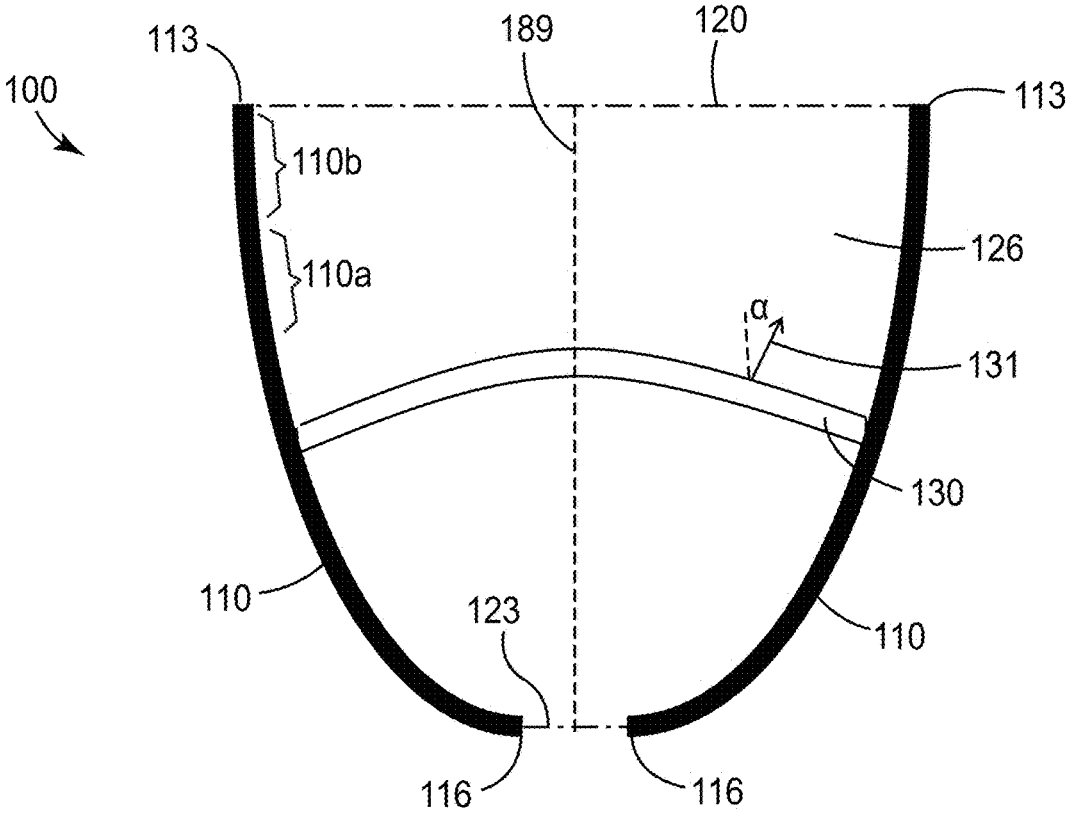
FIG. 1A is a cross-sectional view of a lighting component.

In the following description, reference is made to the accompanying set of drawings that form a part of the description hereof and in which are shown by way of illustration specific embodiments. The figures are not necessarily to scale. Unless indicated otherwise, similar features for one embodiment may include the same materials, have the same attributes, and serve the same or similar functions as similar features for other embodiments. Additional or optional features described for one embodiment may also be additional or optional features for other embodiments, even if not explicitly stated, where appropriate. It is to be understood that other embodiments are contemplated and may be made without departing from the scope or spirit of the present description. The following detailed description, therefore, is not to be taken in a limiting sense.

Spatially related terms, including but not limited to, "lower," "upper," "beneath," "below," "above," and "on top," if used herein, are utilized for ease of description to describe spatial relationships of an element(s) to another. Such spatially related terms encompass different orientations of the device in use or operation in addition to the particular orientations depicted in the figures and described herein. For example, if an object depicted in the figures is turned over or flipped over, portions previously described as below or beneath other elements would then be above those other elements.

As used herein, layers, components, or elements may be described as being adjacent one another. Layers, components, or elements can be adjacent one another by being in direct contact, by being connected through one or more other components, or by being held next to one another or attached to one another. Layers, components, or elements that are in direct contact may be described as being immediately adjacent.

Lighting components, such as luminaries, may be used for general ambient lighting or for task lighting, for example. In some applications, it may be desirable to be able to switch between different types of lighting outputs in real time; that is, without the need to disassemble, reconfigure, and reassemble light fixtures, physically manipulate the lamp, or provide and install additional components. The light output of a lighting component can be altered by disposing a diffuser in the light path. If the diffuser is an electrically switchable diffuser, the output of the lighting component can be altered by electronically changing the state of the switchable diffuser. It has been found that disposing a switchable diffuser in an optical volume in such a way that at least one light path makes multiple passes through the switchable diffuser can provide an improved ability to alter the output distribution of the lighting component compared to configurations where light makes only one pass through the switchable diffuser. This allows a switchable diffuser with a relatively low haze state to have a significant effect on the output distribution of the light source and/or the position or direction of the light output. The optical volume may have an input surface, a distal surface opposite the input surface and at least one reflective or transflective outer major surface. By suitably constructing the at least one reflective or transflective outer major surface and by suitably disposing a switchable diffuser in the optical volume, the angular distribution, the spectral distribution, and/or the polarization distribution of the light output can be changed depending on the state of the switchable diffuser.

In some embodiments, the switchable diffuser is angled so that it has a surface normal (i.e., the normal vector to a major surface of the switchable diffuser) that is not parallel to an optical axis of the optical volume. As used herein, the optical axis of an optical volume having a light injection region and an output surface refers to a line between the center of the light injection region and the center of the output surface. The light injection region, the output surface and the optical volume may or may not have any particular symmetry. The center of the light injection region may be defined as a centroid (geometric center of a volume or surface) of the light injection region and the center of the output surface may be defined as the centroid of the output surface. In this way, an optical axis can be defined for an optical volume even when the optical volume has no symmetry axis. In some embodiments, the optical axis is a symmetry axis of the optical volume. In some embodiments, the switchable diffuser is angled so that it has a surface normal that is not parallel to a direction of average light output when the switchable diffuser is in a first state. The first state may be a substantially spatially uniform state and may be a substantially clear state. In some embodiments, the switchable diffuser is curved so that it has a surface normal in at least some portions that is not parallel to the optical axis of the optical volume and/or is not parallel to a direction of average light output of the optical volume when the first switchable diffuser is in the first state. The angle between the surface normal and the optical axis or between the surface normal and a direction of average light output, may be greater than 10 degrees or greater than 20 degrees or greater than 30 degrees and may be less than or equal to 90 degrees, in at least some portions of the switchable diffuser. Having a surface normal that is not parallel to the optical axis and/or to the average light output direction has been found to aid in diffusion of the output light and may soften or spread high intensity regions (i.e., "hot spots") associated with one or more lighting components. In embodiments where the light source includes different color light emitting diodes (LEDs), such switchable diffuser geometries have been found to aid in mixing the different colors.

In some embodiments, the at least one reflective or transflective outer major surface of the optical volume may have a spatially varying reflective property, such as reflectance, or reflectance to transmission ratio, or the ratio of diffuse to specular reflection, or other reflective properties described herein. Tailoring the reflectivity of the at least one reflective or transflective outer major surface allows the output of the lighting component to be desirably tailored. In some embodiments, the switchable diffuser has a plurality of independently addressable regions. In some embodiments, the at least one reflective or transflective outer major surface includes a plurality of zones having a reflective property that varies from zone to zone. In some embodiments, the plurality of zones is in correspondence to the plurality of independently addressable regions. For example, a light incident on a particular region of the switchable diffuser may be predominately incident on a particular zone of the at least one reflective or transflective outer major surface. Having a plurality of regions and zones in correspondence allows for a high degree of fine-tunability to the light output of the lighting component.

In some embodiments, the optical volume may be substantially hollow or substantially monolithic (e.g., a monolithic optically clear solid) except for the switchable diffuser and optional optical elements such as a lens and additional diffusers. In some embodiments, all components disposed in the optical volume are low-absorbing. As used herein, "low-absorbing" films or components are films or components that absorb less than about 20 percent of the luminous flux of an input light from standard illuminant E having a Lambertian angular distribution. Standard illuminant E is an equal-energy illuminant having a spectral power distribution that is constant over the visible wavelength range (380 nm-780 nm).

As used herein, switchable diffusers refer to electrically switchable diffusers having at least a first state and a second state different from the first state. Such diffusers typically include a material, such as smectic A liquid crystal or polymer dispersed liquid crystal (PDLC), which is configured to change states such that the switchable diffuser has a first haze when the material is in a first state and has a second haze different from the first haze when the material is in a second state different from the first state. In some embodiments, the switchable diffuser includes a layer of smectic A material having a thickness in a range of about 5 microns to about 20 microns. A switchable diffuser including smectic A liquid crystal can have an on-axis haze of about 3% or less when the switchable diffuser is in a substantially clear state. In some cases, the on-axis haze can be as low as 1%. In contrast, PDLC diffusers have an on-axis haze of greater than 5% when in their clearest state. The off-axis haze of a PDLC diffuser is significantly higher than 5% when in its clear state, while the off-axis haze of a smectic A diffuser remains low in its clear state. The switchable diffuser may be capable of being in any number of distinct states. In some embodiments, a switchable diffuser (or each independently switchable region of a switchable diffuser) is capable of being in distinct first, second or third states, characterized by a first, second or third haze, respectively, where each of the first, second and third hazes are different.

Haze can be defined as the percent of transmitted light that is scattered so that its direction deviates more than 2.5 degrees from the direction of the incident beam as specified in ASTM D1003-13 "Standard Test Method for Haze and Luminous Transmittance of Transparent Plastics". Haze can be determined using a HAZE-GARD PLUS meter available from BYK-Gardner Inc. (Silver Springs, Md.) which is said to comply with the ASTM D1003-13 standard.

As used herein, a "bistable" switchable diffuser is an electrically switchable diffuser having one or more regions where each region has two or more states that are substantially stable. "Substantially stable" means that the states are maintained over a time period, such as hours or days, without a voltage applied across the switchable diffuser. In some embodiments, the switchable diffuser includes smectic A liquid crystal which is bistable. Electrically switchable diffusers using smectic A liquid crystal have a substantially stable substantially clear state, and a plurality of substantially stable hazy states that can be characterized by the haze value in the various hazy states. Any of the lighting components described herein may include switchable diffusers having a plurality of independently addressable regions where each region can be in a plurality of states. Each independently addressable region may be in at least a first state or a second state. If all regions of the switchable diffuser are in the first state, the switchable diffuser may be described as being in the first state. Similarly, if all regions of the switchable diffuser are in the second state, the switchable diffuser may be described as being in the second state. The switchable diffuser may be described as being in a substantially spatially uniform state if all regions of the switchable diffuser are in substantially the same state.

A voltage waveform may be applied to a switchable diffuser in order to change the state of the diffuser. Voltage waveforms needed to cause smectic A material, or other switchable diffuser material, to change states are known in the art. Suitable waveforms are described, for example, in U.S. Pat. No. 4,893,117 (Blomley et al.). In some embodiments, a low-frequency waveform is applied to switch regions from a clear state to a hazy state and a high-frequency waveform is used to switch regions from a hazy state to a clear state. In some embodiments, the low-frequency waveform has a frequency in the range of about 10 Hz to about 100 Hz (for example, about 50 Hz). In some embodiments, the high-frequency waveform has a frequency in the range of about 0.5 kHz to about 4 kHz (for example, about 1 kHz).

The hazy state can be adjusted by the time that the voltage waveform is applied to the switchable diffuser in the clear state. For example, a low-frequency waveform applied to a switchable diffuser in the substantially clear state for a first time period can result in a first hazy state having a first haze and a low-frequency waveform applied to a switchable diffuser in the substantially clear state for a second time period can result in a second hazy state having a second haze that is different from the first haze. For example, the first time period can be 800 ms and the second time period can be 400 ms resulting in a first haze that is higher than the second haze.

Using a plurality of independently addressable regions allow the switchable diffuser to modify an output of a light source to produce a desired output distribution. For example, if the output distribution for a source is known and if it differs from a desired output distribution, the switchable diffuser can be adjusted so that the output distribution is altered to the desired distribution. For example, if the output of a light source produces too much light in a first region and too little light in a second region, the switchable diffuser can be adjusted to diffuse light out of the first region and into the second region. The output distribution may refer to angular, distance or position distribution, frequency distribution, polarization distribution or combinations thereof.

Figure 1B:
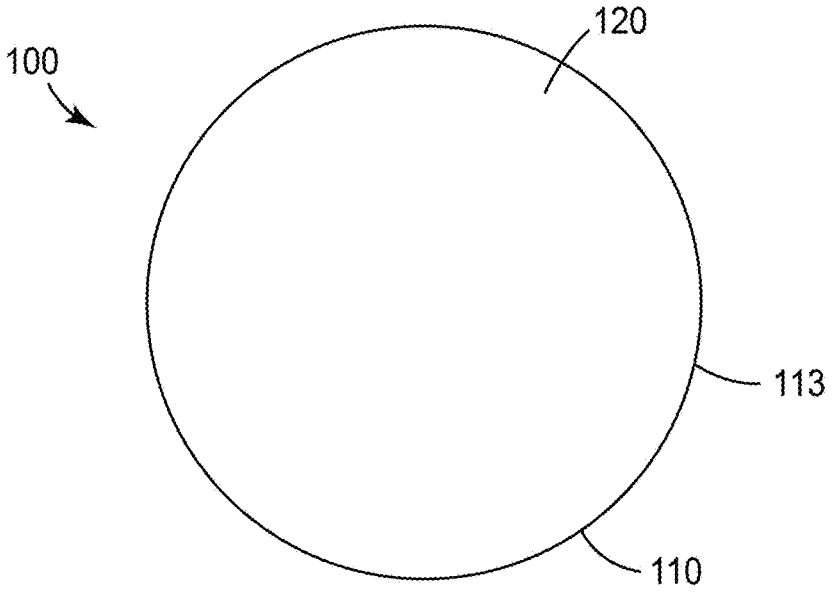
FIG. 1B is a top view of the lighting component of FIG. 1A.

FIGS. 1A and 1B show a cross-sectional and a top view, respectively, of lighting component 100 including reflective or transflective outer major surface 110 having distal edge 113 and proximal edge 116, output major surface 120, light injection region 123, optical volume 126, and switchable diffuser 130 disposed in optical volume 126. Switchable diffuser 130 has a surface normal 131. As used herein, the terms distal and proximal refer to positions relative to a light injection region. Output major surface 120 is a distal surface adjacent distal edge 113 of reflective or transflective outer major surface 110. Light injection region 123 is adjacent proximal edge 116 of reflective or transflective outer major surface 110. In the illustrated embodiment, light injection region 123 is an input surface of the optical volume. In other embodiments, light injection region 123 is a volume adjacent the proximal edge 116 which contains a light source or light sources and/or optical elements such as a lens or lenses. The light source may include one or more light emitting diodes (LEDs) and may extend into the optical volume 126. In the illustrated embodiment, switchable diffuser 130 is disposed entirely in optical volume 126. In other embodiments, a switchable diffuser may be only partially disposed in an optical volume. Output major surface 120 may be a planar surface defined by distal edge 113. For example, output major surface 120 may be a planar region bounded by distal edge 113. Similarly, light injection region 123 may be a planar surface defined by proximal edge 116. For example, light injection region 123 may be a planar region bounded by proximal edge 116.

Lighting component 100 has an optical axis 189 which may coincide with a direction of average light output. In some embodiments, the direction of average light output is determined by a symmetry axis of the lighting component 100. In some embodiments, the switchable diffuser 130 and/or the reflective or transflective outer major surface 110 is asymmetric and the direction of average light output may depend on the state of the switchable diffuser 130. In some embodiments, the output major surface 120, which is a distal surface of the optical volume 126, is substantially orthogonal to the direction of average light output of the optical volume 126 when the switchable diffuser 130 is in a substantially spatially uniform state, which may be a substantially clear state. In some embodiments, the output major surface 120, is substantially orthogonal to the optical axis 189. In some embodiments, switchable diffuser 130 includes a surface normal 131 which, in at least a portion of the switchable diffuser 130, is not parallel to the optical axis 189. This can occur when the switchable diffuser has a curved shape as illustrated in FIG. 1A or can occur with a flat switchable diffuser disposed in the lighting component 100 at an angle $\alpha$ relative to the optical axis 189. The angle $\alpha$ between the surface normal 131 and the optical axis 189 of the optical volume 126, may be greater than 10 degrees or greater than 20 degrees or greater than 30 degrees and may be less than or equal to 90 degrees, in at least some sections of the switchable diffuser. An angle greater than 90 degrees is equivalent to a complement angle less than 90 degrees, so only angles from zero to 90 degrees need to be considered.

In some embodiments, reflective or transflective outer major surface 110 may have uniform or substantially uniform reflectance and/or transmittance, while in other embodiments the reflective or transflective outer major surface 110 may have reflectance and/or transmittance properties that varies along the surface. The variation may be substantially continuous or discrete regions may have distinct reflectance and/or transmittance properties. For example, region 110*a* and region 110*b* may have differing reflectance and/or transmittance properties. Such properties may include differing overall reflectance and/or transmittance, and/or differing wavelength dependent reflectance and/or transmittance, and/or or differing polarization dependent reflectance and/or transmittance. For example, the ratio of reflectance to transmittance may vary spatially. The reflectance and/or transmittance may refer to visible, near infrared or ultraviolet light. The shape and/or the reflectance and/or transmittance properties of reflective or transflective outer major surface 110 may be selected such that switching the switchable diffuser from a first state to a second state changes the angular distribution and/or the spectral distribution and/or the polarization distribution of light output from lighting component 100. The shape may be adjusted, for example, by providing a segmented or faceted surface having variable surface normal. Such faceted surfaces are described further elsewhere. The reflectance and/or transmittance properties of the reflective or transflective outer major surface 110 can also be adjusted by varying the surface texture. For example, the reflective or transflective outer major surface 110 may have a spatially varying texture that provides a spatially varying degree of diffuse reflectance or transmittance. For example, in some embodiments, the reflective or transflective outer major surface 110 provides a ratio of diffuse to specular reflectivity that is spatially varying.

Figure 22:
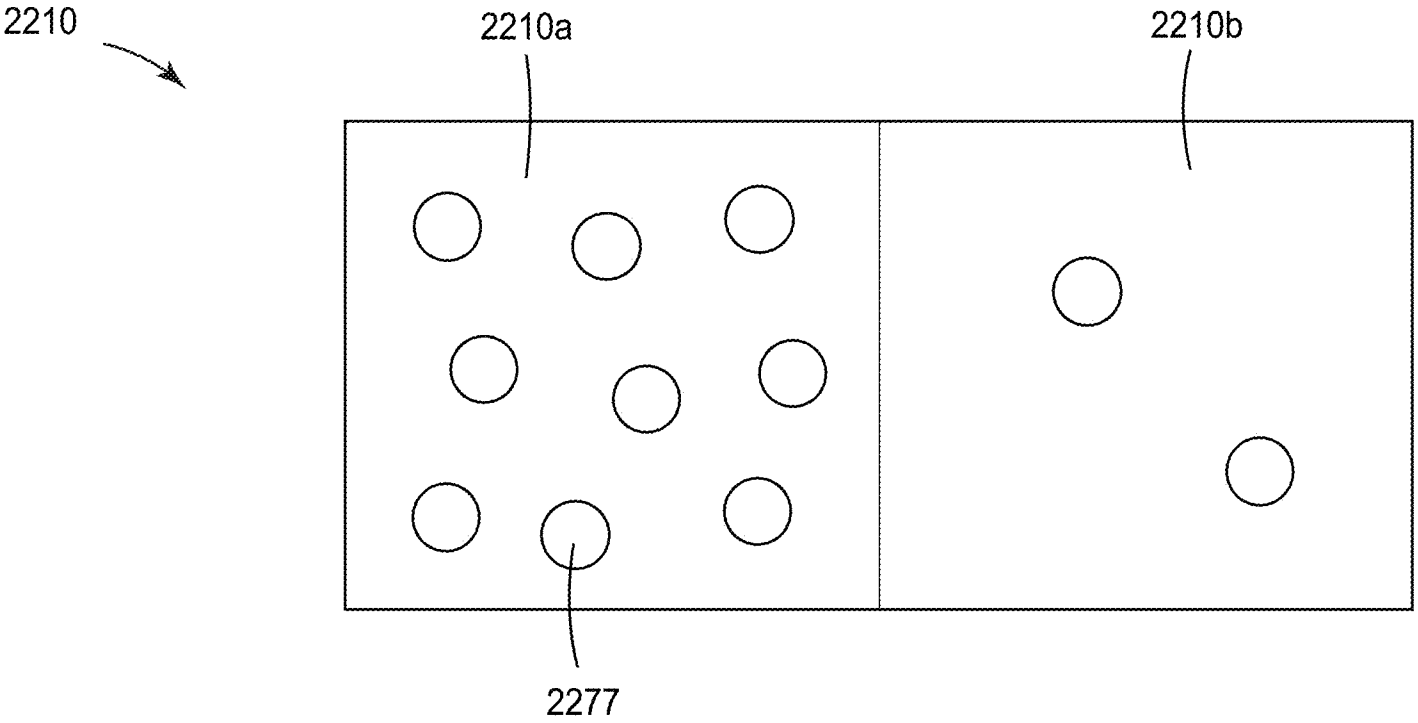
FIG. 22 is a schematic top view of a silm having a spatial variation in perforation density.

In any embodiments of the present description, a reflective or transflective outer major surface may be formed using a reflective or transflective film. Suitable reflective or transflective film includes multilayer optical film (MOF) that includes a plurality of alternating birefringent polymer layers as described in U.S. Pat. No. 5,882,774 (Jonza et al.), U.S. Pat. No. 6,179,948 (Merrill et al.), and U.S. Pat. No. 6,783,349 (Neavin et al.). Differing distinct reflectance and/or transmittance properties can be achieved by using a perforated reflective or transflective film, which may be an MOF, where the perforation density varies along the reflective or transflective outer major surface. For example, reflective or transflective outer major surface 110 may include a perforated reflective or transflective film having differing perforation densities in region 110*a* and 110*b*. FIG. 22 is a schematic top view of a perforated reflective or transflective film 2210 schematically illustrating perforations 2277 where the film 2210 has different perforation densities in zone 2210*a* and zone 2210*b*. The perforated reflective or transflective film may be a perforated reflector film or a perforated reflective polarizer, for example. The perforated reflector film may be a wide-band reflector, such as Enhanced Specular Reflector (available from 3M Company), or may be reflective in only some wavelength bands so that the reflective properties are wavelength dependent. Suitable reflective polarizers include DBEF (available from 3M Company). Other suitable reflective or transflective films include Transflective Display Film (available from 3M Company).

In some embodiments, a reflective or transflective outer major surface 110 is formed using a transparent substrate with one or more MOF layers attached to the substrate. In some embodiments, one or more MOF layers may be disposed between two substrates. In such embodiments, the MOF layers may be understood as defining outer boundaries of an optical volume and one of the two substrate layers may be considered to be outside the optical volume established by the MOF layers. Regions 110*a* and 110*b* may include differing MOF layers. The MOF layers may include broad band reflectors, wavelength dependent reflectors, reflective polarizers, asymmetric reflectors (reflectors that reflect more of a first polarization than a second polarization orthogonal to the first polarization), or combinations thereof.

Other reflectors or transflectors may include, but are not limited to, metallic (e.g., aluminum) reflectors or transflectors, reflectors or transflectors made by physical vapor deposition, reflectors or transflectors having particles in a matrix (e.g., reflective particles in a polymer matrix), voided reflectors or transflectors (e.g., reflective particles in a polymer matrix that includes voids in order to provide diffuse reflectance), or reflectors or transflectors that provide total internal reflection (TIR). Suitable voided reflectors that include particles in a polyester matrix are described in U.S. Pat. No. 7,273,640 (Laney, et al.), for example.

Any of the lighting components described herein may include a reflective or transflective outer major surface having spatially varying reflective properties. For example, the ratio of reflectance to transmission may vary spatially. In some embodiments, the spatially varying reflective properties include one or more of the reflectivity of unpolarized light in a wavelength band of interest, the reflectivity of polarized light having a first polarization state in the wavelength band, the degree of diffuse reflectivity of unpolarized light in the wavelength band, and the degree of diffuse reflectivity of polarized light having the first polarization state in the wavelength band. The wavelength band of interest may be the visible wavelength band (e.g., wavelengths in the range of 380 nm-780 nm) or may be near infrared (IR) or ultraviolet (UV) bands or may be bands overlapping with one or more of the visible, IR and UV ranges. Near infrared may refer to wavelengths in the range of 780 nm-2000 nm, for example.

The light output from any of the lighting components described herein may have differing output angular distributions, differing output spectral distributions (e.g., differing color output), differing polarization output distributions, or a combination thereof, when a switchable diffuser is changed from a first state to a second state differing from the first state.

In some embodiments, lighting component 100 is substantially hollow except for switchable diffuser 130. In some embodiments, lighting component 100 is substantially monolithic except for switchable diffuser 130. Any of the lighting components of the present description may be substantially hollow or substantially monolithic except for the switchable diffuser, optional additional diffusers, optional optical elements (e.g., a lens or LEDs) in the light injection region.

In some embodiments, the optical volume includes a single reflective or transflective outer major surface which may be curved in a single direction to produce a cone, for example, or may be curved in two directions to produce a curved surface of revolution about an axis, for example, as illustrated in FIGS. 1A-1B. In some embodiments, the curved surface of revolution is a compound curve, which may, for example, be generated by revolution of multiple curves about an axis. In some embodiments, the optical volume may include more than one reflective or transflective outer major surface. The at least one reflective or transflective outer major surface may include two or more planar surfaces not all in a common plane or may include one or more surfaces curved in one direction or curved in two directions.

A surface may be described as reflective if it reflects most of a light energy in a wavelength band of interest that is injected into the optical volume from the light injection region and incident on the surface. For example, a reflective surface may reflect at least about 70 percent, or at least about 80 percent, or at least about 90 percent of a light energy incident on the surface and injected into the optical volume from the light injection region. As described elsewhere, the wavelength band of interest may include light in the visible, IR and/or UV ranges. A surface may be described as transflective if it reflects a portion and transmits a portion of a light energy in a wavelength band of interest that is injected into the optical volume from the light injection region and incident on the surface. For example, a transflective surface may reflect in the range of 10 percent to 90 percent of a light energy incident on the surface and injected into the optical volume from the light injection region, and may transmit in the range of 10 percent to 90 percent of a light energy incident on the surface and injected into the optical volume from the light injection region. A transflective surface may reflect a substantial portion of a light energy incident on the surface and injected into the optical volume from the light injection region through a total internal reflection mechanism (TIR) as described elsewhere.

As used herein, a major surface of an optical volume is a surface that either makes up at least about 5 percent (or at least about 7 percent, or at least about 10 percent, or at least about 15 percent, or at least about 20 percent) of the total area of the boundary of the optical volume or is disposed such that when a light is injected into the light injection region of the optical volume, at least about 5 percent (or at least about 7 percent, or at least about 10 percent, or at least about 15 percent, or at least about 20 percent) of the light energy (which may include one or more of visible, near infrared and ultraviolet light energies) that is output from the optical volume is output through the surface. In some cases a boundary of an optical volume may include an edge of a film. Such an edge may make up less than 2 or 3 percent of the total area of the boundary and may provide a small light output (e.g., less than 2 or 3 percent of a light energy that is output from the optical volume). Such a surface would be considered a minor surface, not a major surface. In some embodiments, a lighting component includes an output major surface and at least about 40 percent, or at least about 50 percent, or at least about 60 percent, or at least about 70 percent of the light energy that is output from the optical volume is output through the output major surface when a switchable disposed at least partially in an optical volume of the lighting component is in a first state.

The switchable diffusers used in the lighting components of the present description may have a structured surface or may include a structured layer attached to the switchable diffuser. In such cases, the surface normal of the switchable diffuser refers to a vector normal to the overall shape of the switchable diffuser rather than to the shape of the structured layer. In embodiments where the switchable diffuser includes a liquid crystal layer, the surface normal may refer to a surface of the liquid crystal layer and not to any microstructured surface, for example, that may be formed in a layer adjacent to the liquid crystal layer.

Figure 2A:
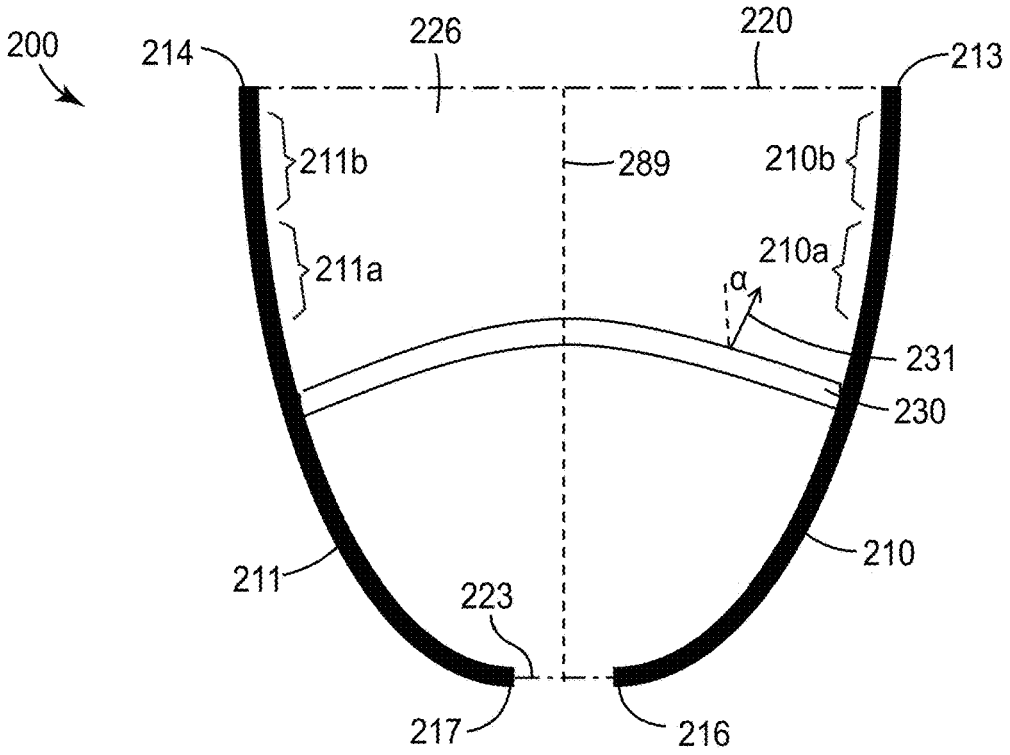
FIG. 2A is a cross-sectional view of a lighting component.
Figure 2B:
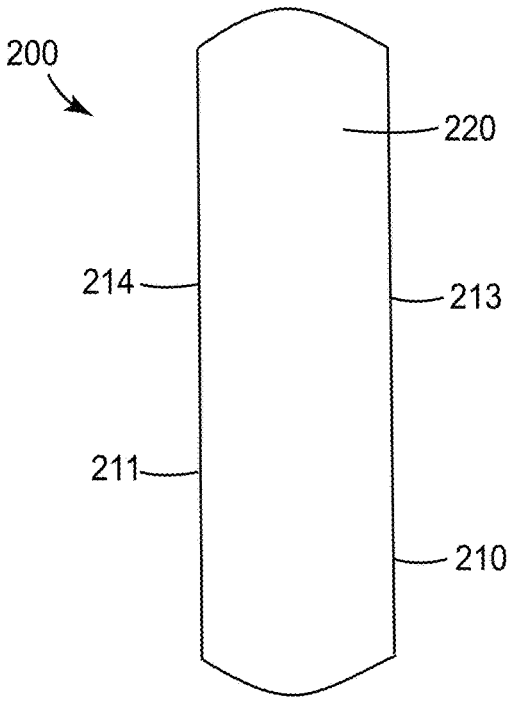
FIG. 2B is a top view of the lighting component of FIG. 2A.

FIGS. 2A and 2B show a cross-sectional and a top view, respectively, of lighting component 200 including first and second reflective or transflective outer major surfaces 210 and 211. First reflective or transflective outer major surface 210 includes first distal edge 213 and first proximal edge 216, and second reflective or transflective outer major surface 211 includes second distal edge 214 and second proximal edge 217. Lighting component 200 also includes output major surface 220, light injection region 223, optical volume 226, and switchable diffuser 230 disposed in optical volume 226. Switchable diffuser 230 has a surface normal 231. Lighting component 200 has an optical axis 289 and at least a portion of switchable diffuser 230 has a surface normal 231 that is not parallel to the optical axis 289. The angle $\alpha$ between the surface normal 231 and the optical axis 289, may be greater than 10 degrees or greater than 20 degrees or greater than 30 degrees and may be less than or equal to 90 degrees, in at least some sections of the switchable diffuser 230. Output major surface 220 is a distal surface adjacent first distal edge 213 and second distal edge 214. Light injection region 223 is adjacent first proximal edge 216 and second proximal edge 217. In the illustrated embodiment, light injection region 223 is an input surface of the optical volume. In other embodiments, light injection region 223 is a volume adjacent first and second proximal edges 216 and 217 that may contain a light source and/or optical elements such as a lens or lenses or LEDs. In the illustrated embodiment, switchable diffuser 230 is disposed entirely in optical volume 226. In other embodiments, a switchable diffuser may be only partially disposed in an optical volume. First and second reflective or transflective outer major surfaces 210 and 211 are curved in one direction and substantially flat in the orthogonal direction.

Output major surface 220 may be a planar surface defined by first and second distal edges 213 and 214. For example, output major surface 220 may be a planar region substantially bounded by first and second distal edges 213 and 214. Similarly, light injection region 223 may be a planar surface defined by first and second proximal edges 216 and 217. For example, light injection region 223 may be a planar region substantially bounded by first and second proximal edges 216 and 217.

In some embodiments, first and second reflective or transflective outer major surfaces 210 and 211 may have uniform or substantially uniform reflectance and/or transmittance while in other embodiments first and second reflective or transflective outer major surfaces 210 and 211 may have reflectance and/or transmittance properties that varies along the surfaces. The variation may be substantially continuous or discrete regions may have distinct reflectance and/or transmittance properties. For example, regions 210*a*, 210*b*, 211*a*, and/or 211*b* may have differing reflectance and/or transmittance properties. Differing reflectance and/or transmittance properties can be achieved, for example, using MOF films as described elsewhere. The shape and/or the reflectance and/or transmittance properties of the first and second reflective or transflective outer major surfaces 210 and 211 may be selected such that switching the switchable diffuser 230 from a first state to a second state changes the angular distribution and/or the spectral distribution and/or the polarization distribution of light output from lighting component 200.

In some embodiments, lighting component 200 is substantially hollow except for switchable diffuser 230. In some embodiments, lighting component 200 is substantially monolithic except for switchable diffuser 230.

In some embodiments, optical axis 289 is determined by a symmetry direction of the lighting component 200. In some embodiments, a direction of average light output is coincident with optical axis 289. In some embodiments, the switchable diffuser 230 and/or the reflective or transflective outer major surfaces 210 and/or 211 are asymmetric and the direction of average light output may depend on the state of the switchable diffuser 230. In some embodiments, the output major surface 220, which is a distal surface of the optical volume 226, is substantially orthogonal to the optical axis 289 and/or is substantially orthogonal to the direction of average light output of the optical volume 226 when the switchable diffuser 230 is in the first state, which may be a substantially clear state.

Figure 3:
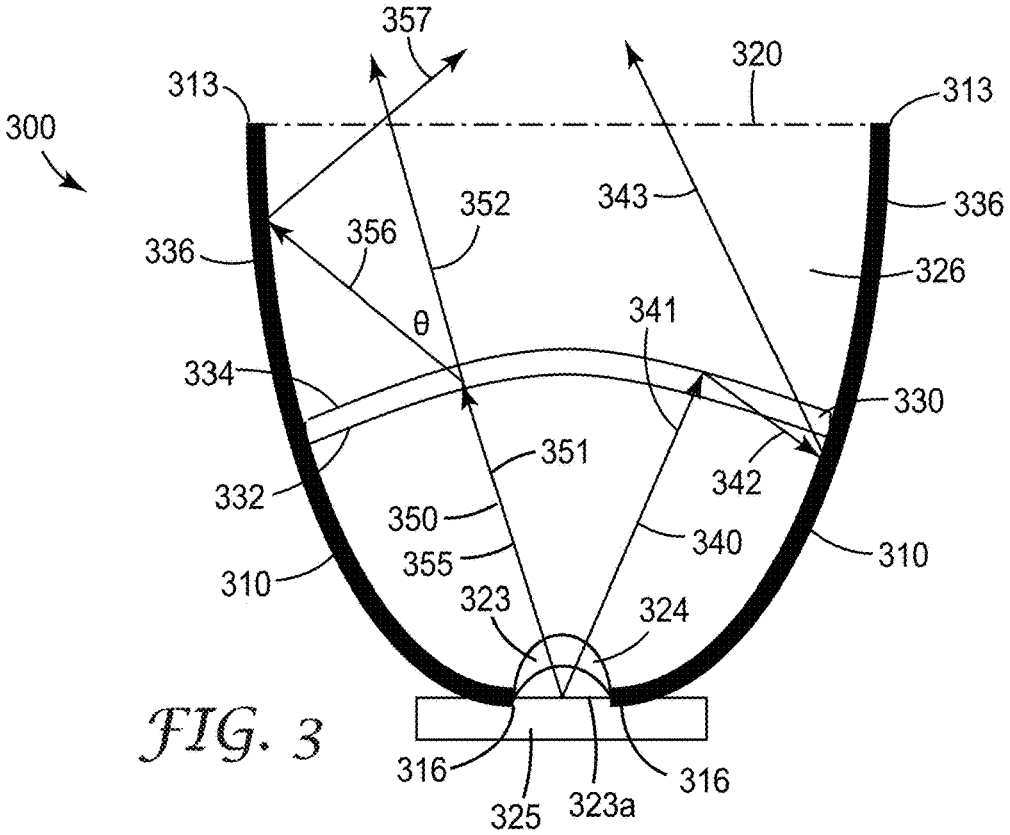
FIGS. 3-6 are cross-sectional views of lighting components.

FIG. 3 shows a cross-sectional view of lighting component 300 including at least one reflective or transflective outer major surface 310 having at least one distal edge 313 and at least one proximal edge 316, output major surface 320, light injection region 323, lens component 324, light source 325, optical volume 326, and switchable diffuser 330 disposed in optical volume 326. Light source 325 may include one or more individual lighting elements (e.g., one or more LEDs) and may extend into optical volume 326. Switchable diffuser 330 includes first major surface 332 and second major surface 334. Output major surface 320 is a distal surface adjacent the at least one distal edge 313 of the at least one reflective or transflective outer major surface 310. Light injection region 323 is adjacent the at least one proximal edge 316 of the at least one reflective or transflective outer major surface 310. In the illustrated embodiment, light injection region 323 is a volume including lens component 324. Light injection region 323 may include an input surface 323*a*. In some embodiments, light injection region 323 is an input surface 323*a* adjacent the at least one proximal edge 316 and lens component 324 is positioned outside of the optical volume 326. In the illustrated embodiment, switchable diffuser 330 is disposed entirely in optical volume 326. In other embodiments, a switchable diffuser may be only partially disposed in an optical volume. Switchable diffuser 330 has a surface normal in portions of the switchable diffuser 330 that is not parallel to an optical axis and/or that is not parallel to an average direction of light output which may be a symmetry axis of lighting component 300. Output major surface 320 may be a planar surface defined by the at least one distal edge 313. For example, output major surface 320 may be a planar region bounded by the at least one distal edge 313. Similarly, input surface 323*a* may be a planar surface defined by the at least one proximal edge 316. For example, input surface 323*a* may be a planar region bounded by the at least one proximal edge 316.

The at least one reflective or transflective outer major surface 310 includes a portion 336 opposite the switchable diffuser 330 from light injection region 323. Portion 336 extends from the switchable diffuser 330 to the at least one distal edge 313. In some embodiments, the at least one reflective or transflective outer major surface 310 is a single surface (corresponding to surface 110 in FIGS. 1A-1B) and in some embodiments, the at least one reflective or transflective outer major surface 310 is two surfaces (corresponding to surfaces 210 and 211 in FIGS. 2A-2B). In other embodiments, the at least one reflective or transflective outer major surface 310 includes more than two surfaces. Portion 336 may also be a single surface, two surfaces or more than two surfaces.

The lighting component 300 includes a light path 340 which includes first, second and third segments 341, 342 and 343. First segment 341 extends from light injection region 323 through first major surface 332 to second major surface 334 where it is reflected as second segment 342. Second segment 342 passes back through first major surface 332 and reflects from at least one reflective or transflective outer major surface 310 as third segment 343 which exits optical volume 326 through output major surface 320. Light path 340 extends from light injection region 323 to output major surface 320 and includes a plurality of passes through switchable diffuser 330. Light path 340 does not include any reflections from output major surface 320 and does not include any portions or segments that pass into optical volume 326 from a region outside optical volume 326. In some embodiments, optical volume 326 is filled with a substantially optically clear material. In such embodiments, additional light paths may include reflections from output major surface 320. In some embodiments, an object placed outside of optical volume 326 may reflect light output from the lighting component 300 back into lighting component 300 through output major surface 320. In such embodiments, lighting component 300 still may include a light path 340 from light injection region 323 to output major surface 320 that includes a plurality of passes through switchable diffuser 330, where the light path does not include any reflections from output major surface 320 and does not include any portions that pass into optical volume 326 through output major surface 320.

The lighting component 300 also includes light path 350, which includes first and second segments 351 and 352, and includes light path 355, which includes the first segment 351 and includes a second segment 356 and a third segment 357. Light path 350 starts from light injection region 323 and extends through output major surface 320. Light path 350 does not include any reflections from output major surface 320, does not include any portions or segments that pass into optical volume 326 through output major surface 320 from a region outside optical volume 326, and does not include backscattering from switchable diffuser 330. First segment 351 starts at light injection region 323 and ends at switchable diffuser 330. In embodiments where the light injection region is an input surface and a light source is configured to inject light through the input surface, the first segment may be understood to start at the light source and extend through the input surface. For light path 350, first segment 351 is transmitted through switchable diffuser substantially without scattering as second segment 352. This may occur, for example, when the switchable diffuser is in a first state which may be a characterized by a first haze. In some embodiments, the first state is a substantially clear state and the first haze is substantially zero. For light path 355, first segment 351 is scattered with a scattering angle θ as it is transmitted through switchable diffuser 330 and becomes second segment 356 which is reflected from at least one reflective or transflective outer major surface 310 as third segment 357. The scattering of light path 355 by switchable diffuser 330 may occur, for example, when the switchable diffuser is in a second state which may be a characterized by a second haze different from the first haze. For example, the second haze may be significantly greater than the first haze. A light path may be said to include backscattering from switchable diffuser 330 if it is scattered through an angle θ greater than 90 degrees by the switchable diffuser. Light path 355 does not include backscattering, though other light paths may include backscattering.

In some embodiments, the at least one reflective or transflective outer major surface 310 may have uniform or substantially uniform reflectance and/or transmittance while in other embodiments, the at least one reflective or transflective outer major surface 310 may have reflectance and/or transmittance properties that varies along the surface. The variation may be substantially continuous or discrete regions may have distinct reflectance and/or transmittance properties as described elsewhere. The shape and/or the reflectance and/or transmittance properties of the at least one reflective or transflective outer major surface 310 may be selected such that switching the switchable diffuser 330 from a first state to a second state changes the angular distribution and/or the spectral distribution and/or the polarization distribution of light output from lighting component 300.

Figure 4:
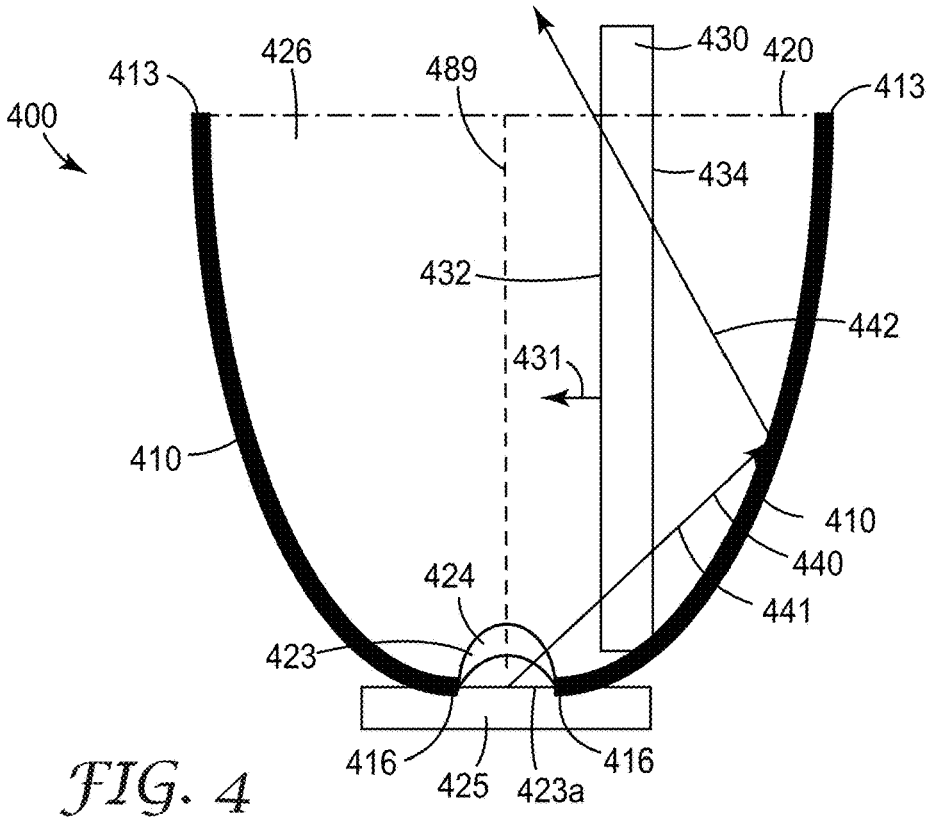

FIG. 4 shows a cross-sectional view of lighting component 400 including at least one reflective or transflective outer major surface 410 having at least one distal edge 413 and at least one proximal edge 416, output major surface 420, light injection region 423, lens component 424, light source 425, optical volume 426, and switchable diffuser 430 disposed at least partially in optical volume 426. Switchable diffuser 430 includes first major surface 432 and second major surface 434. Output major surface 420 is a distal surface adjacent the at least one distal edge 413 of at least one reflective or transflective outer major surface 410. Light injection region 423 is adjacent the at least one proximal edge 416 of reflective or transflective outer major surface 410. In the illustrated embodiment, light injection region 423 is a volume including lens component 424. Light injection region 423 may include an input surface 423*a*. In some embodiments, light injection region 423 is an input surface 423*a* adjacent at least one proximal edge 416 and the light source 425 and lens component 424 are positioned outside of the optical volume 426. In some embodiments, light source 425 may include one or more individual lighting elements (e.g., one or more LEDs) and may extend into optical volume 426. In the illustrated embodiment, switchable diffuser 430 is disposed partially within optical volume 426. In other embodiments, a switchable diffuser may be disposed entirely within an optical volume. Output major surface 420 may be a planar surface defined by the at least one distal edge 413 and input surface 423*a* may be a planar surface defined by the at least one proximal edge 416.

Switchable diffuser 430 is disposed substantially vertically so that a surface normal 431 of the switchable diffuser 430 is substantially perpendicular to the optical axis 489 which may be the direction of average light output when the switchable diffuser 430 is in a substantially clear state. In other embodiments, the switchable diffuser 430 may be disposed at some skew angle (i.e., some angle other than zero or 90 degrees) relative to the optical axis 489.

In some embodiments, the at least one reflective or transflective outer major surface 410 is a single surface (corresponding to surface 110 in FIGS. 1A-1B) and in some embodiments, the at least one reflective or transflective outer major surface 410 is two surfaces (corresponding to surfaces 210 and 211 in FIGS. 2A-2B). In other embodiments, at least one reflective or transflective outer major surface 410 includes more than two surfaces.

As illustrated in FIG. 4, the lighting component 400 includes a light path 440 which includes first and second segments 441 and 442. First segment 441 extends from light injection region 423 through first major surface 432 and second major surface 434 to the at least one reflective or transflective outer major surface 410 where it is reflected as second segment 442. Second segment 442 passes through second major surface 434 and first major surface 432 and is then transmitted through output major surface 420. Light path 440 extends from light injection region 423 to output major surface 420 and includes a plurality (two in this case) of passes through switchable diffuser 430. Light path 440 does not include any reflections from output major surface 420 and does not include any portions or segments that pass into optical volume 426 from a region outside optical volume 426. Light path 440 does not include Fresnel surface reflections from switchable diffuser 430. In some embodiments, optical volume 426 is filled with a substantially optically clear material. In such embodiments, additional light paths may include reflections from output major surface 420. In some embodiments, an object placed outside of optical volume 426 may reflect light output from the lighting component 400 back into lighting component 400 through output major surface 420. In such embodiments, lighting component 400 still may include a light path 440 from light injection region 423 to output major surface 420 that includes a plurality of passes through switchable diffuser 430, where the light path does not include any reflections from output major surface 420 and does not include any portions that pass into optical volume 426 through output major surface 420.

In some embodiments, the at least one reflective or transflective outer major surface 410 may have uniform or substantially uniform reflectance and/or transmittance while in other embodiments, the at least one reflective or transflective outer major surface 410 may have reflectance and/or transmittance properties that varies along the surface as described elsewhere. The shape and/or the reflectance and/or transmittance properties of the at least one reflective or transflective outer major surface 410 may be selected such that switching the switchable diffuser 430 from a first state to a second state changes the angular distribution and/or the spectral distribution and/or the polarization distribution of light output from lighting component 400.

In some embodiments, lighting component 400 is substantially hollow except for switchable diffuser 430 and lens component 424. In some embodiments, lighting component 400 is substantially monolithic except for switchable diffuser 430 and lens component 424.

Figure 5:
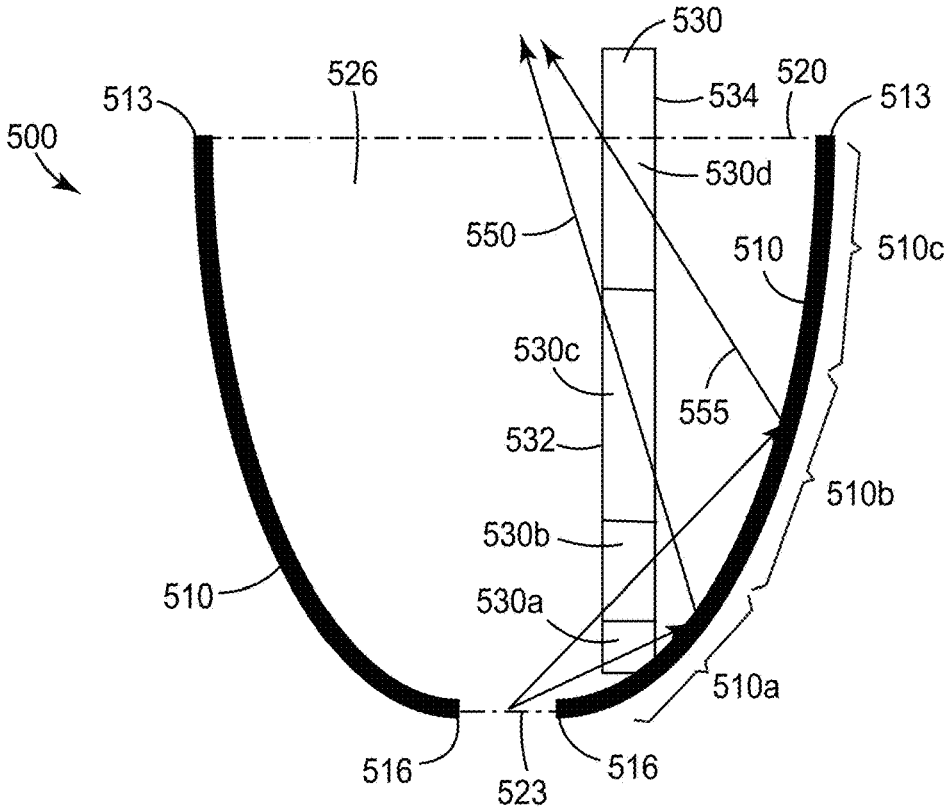

FIG. 5 shows a cross-sectional view of lighting component 500 including at least one reflective or transflective outer major surface 510 having at least one distal edge 513 and at least one proximal edge 516, output major surface 520, light injection region 523, optical volume 526, and switchable diffuser 530 disposed at least partially in optical volume 526. Switchable diffuser 530 includes first major surface 532 and opposing second major surface 534. Output major surface 520 is a distal surface adjacent the at least one distal edge 513 of at least one reflective or transflective outer major surface 510. Light injection region 523 is adjacent the at least one proximal edge 516 of reflective or transflective outer major surface 510. In the illustrated embodiment, light injection region 523 is an input surface. In other embodiments, the light injection region is a volume which may contain a lens component as described elsewhere. Output major surface 520 may be a planar surface defined by the at least one distal edge 513 and light injection region 523 may be a planar surface defined by the at least one proximal edge 516.

In some embodiments, the at least one reflective or transflective outer major surface 510 is a single surface (corresponding to surface 110 in FIGS. 1A-1B) and in some embodiments, the at least one reflective or transflective outer major surface 510 is two surfaces (corresponding to surfaces 210 and 211 in FIGS. 2A-2B). In other embodiments, at least one reflective or transflective outer major surface 510 includes more than two surfaces.

Light ray 550 is injected into light injection region 523, passes through first region 530*a* of switchable diffuser 530, reflects from zone 510*a* of the at least one reflective or transflective outer major surface 510, is transmitted through third region 530*c* of switchable diffuser 530 and exits lighting component 500 through output major surface 520. Light ray 555 is injected into light injection region 523, passes through second region 530*b* of switchable diffuser 530, reflects from zone 510*b* of the at least one reflective or transflective outer major surface 510, is transmitted through fourth region 530*d* of switchable diffuser 530 and exits lighting component 500 through output major surface 520.

In some embodiments, the at least one reflective or transflective outer major surface 510 may have uniform or substantially uniform reflectance and/or transmittance while in other embodiments the at least one reflective or transflective outer major surface 510 may have reflectance and/or transmittance properties that varies along the surface as described elsewhere. The variation may be substantially continuous or discrete zones may have distinct reflectance and/or transmittance properties. For example, zone 510*a*, zone 510*b*, and zone 510*c* may have differing reflectance and/or transmittance properties. Such properties may include differing overall reflectance and/or transmittance of light, which may be visible light, UV light and/or IR light, or may include differing wavelength dependent reflectance and/or transmittance, or may include different degrees of diffuse reflectance or transmittance (e.g., different surface scattering). The degree of diffuse reflection may vary from specular reflection with substantially no diffuse reflection component to diffuse reflection with substantially no specular reflection component (e.g., Lambertian reflection) and may include semi-specular reflection which can be described as partially diffuse and partially specular. The shape and/or the reflectance and/or transmittance properties of the at least one reflective or transflective outer major surface 510 may be selected such that switching the state of the switchable diffuser 530 changes the angular distribution and/or the spectral distribution and/or the polarization distribution of light output from lighting component 500.

Switchable diffuser 530 includes first through fourth independently addressable regions 530*a* through 530*d*. By suitably selecting the regions of the switchable diffuser and/or by selecting the geometry and/or reflectance and/or transmittance properties of the at least one reflective or transflective outer major surface, the light output of lighting component 500 can have a usefully adjustable light output. Any or all of the angular distribution, the spectral distribution, and the polarization distribution of the light output may be adjusted by changing the state of each independently addressable region of switchable diffuser 530.

Switchable diffuser 530 may have any number of independently addressable regions and the at least one reflective or transflective outer major surface 510 may have any number of zones. In some embodiments, the independently addressable regions of the switchable diffuser 530 and the zones of the at least one reflective or transflective outer major surface 510 may be in correspondence. That is, light injected through a region of the switchable diffuser 530 may be predominately incident on a zone of the at least one reflective or transflective outer major surface 510. For example, light injected through region 530*a* is predominately incident on zone 510*a*; light injected though region 530*b* is predominately incident on zone 510*b*; and light injected through region 530*c* is predominately incident on zone 510*c*. The zones may be in correspondence with the regions without necessarily having a one-to-one correspondence. For example, light injected through region 530*d* may exit the lighting component 500 substantially without interacting with the at least one reflective or transflective outer major surface 510. In some embodiments, the zones are in one-to-one correspondence with the regions, while in other embodiments, multiple zones may correspond to a single region or multiple regions may correspond to a single zone.

In some embodiments, the at least one reflective or transflective outer major surface 510 may be shaped such that when the switchable diffuser 530 is in a low haze or a substantially clear state, zones 510*a*, 510*b* and 510*c* reflect light from light injection region 523 into a first, second and third average directions. By selecting regions of the switchable diffuser 530 to place in a hazy state, the light output distribution in some directions can be changed while the light output distribution in other directions are substantially unchanged or only modestly changed. For example, if first region 530*a* were placed in a hazy state, the light output distribution directed in the first average direction may shift while the output in the third average direction is largely unaffected except that some light that would have been directed in the first average direction could be scattered into the third average direction. If zones 510*a*, 510*b* and 510*c* have differing wavelength dependent reflectivities, the spectral distribution or color of the output distribution in some directions may be changed by selecting the states of the independently addressable regions of the switchable diffuser 530. Similarly if zones 510*a*, 510*b* and 510*c* have differing polarization dependent reflectivities, the polarization distribution of the light output in some directions may be changed by selecting the states of the independently addressable regions of the switchable diffuser 530.

Figure 6:
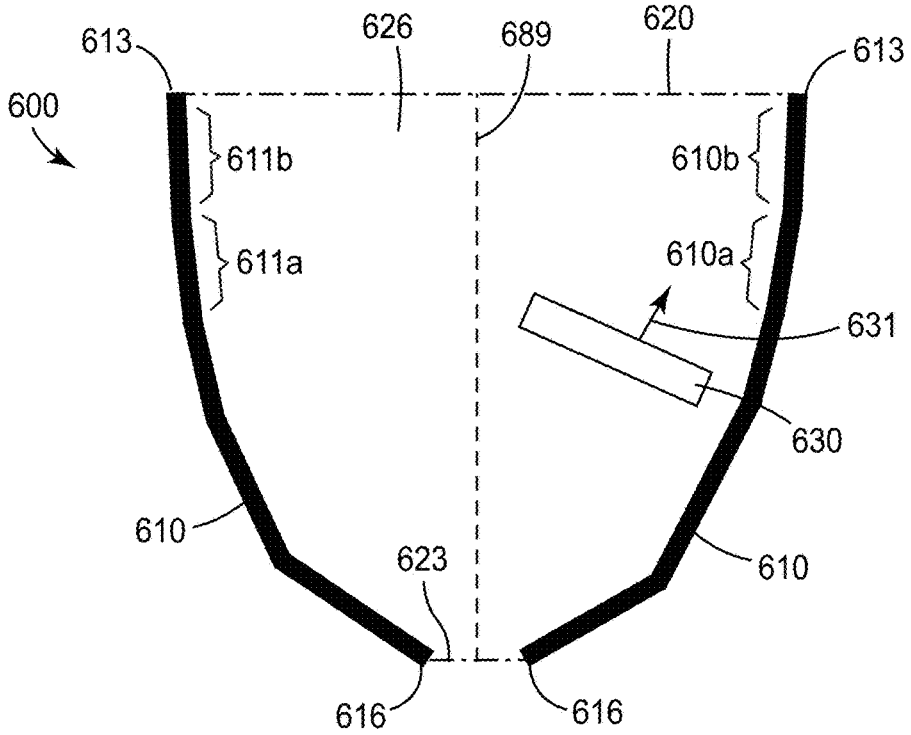

FIG. 6 shows a cross-sectional view of lighting component 600 including at least one reflective or transflective outer major surface 610 having at least one distal edge 613 and at least one proximal edge 616, output major surface 620, light injection region 623, optical volume 626, and switchable diffuser 630 disposed in optical volume 626. Output major surface 620 is a distal surface adjacent the at least one distal edge 613 of the at least one reflective or transflective outer major surface 610. Light injection region 623 is adjacent the at least one proximal edge 616 of the at least one reflective or transflective outer major surface 610. In the illustrated embodiment, light injection region 623 is an input surface; in other embodiments, light injection region volume that may include a lens component and/or portions of lighting elements such as LEDs. Switchable diffuser 630 has a surface normal 631 in portions of the switchable diffuser 630 that is not parallel to the optical axis 689 which may be a symmetry axis of lighting component 600 and which may be a direction of average light output when the switchable diffuser 630 is in a substantially clear state. Output major surface 620 may be a planar surface defined by the at least one distal edge 613. For example, output major surface 620 may be a planar region bounded by the at least one distal edge 613. Similarly, light injection region 623 may be an input surface which may be a planar surface defined by the at least one proximal edge 616. For example, the input surface may be a planar region bounded by the at least one proximal edge 616.

The at least one reflective or transflective outer major surface 610 includes zones 610*a*, 610*b*, 611*a*, and 611*b*. Each zone may correspond to a facet of lighting component 600. Each facet may have similar or may have different reflective properties. For example, the various facets may provide different reflectance, differing ratio of reflectance to transmittance, differing degrees of diffuse reflectance, differing wavelength dependence to the reflectivity, and/or differing polarization dependence to the reflectivity. By suitably selecting the size, shape, distribution, and/or reflectance or transmittance properties of the facets, switching the switchable diffuser 630 from a first state to a second state may change the angular distribution and/or the spectral distribution and/or the polarization distribution of light output from lighting component 600. In the illustrated embodiment, lighting component 600 includes a single switchable diffuser 630. In other embodiments, two or more switchable diffusers are included.

Figure 7A:
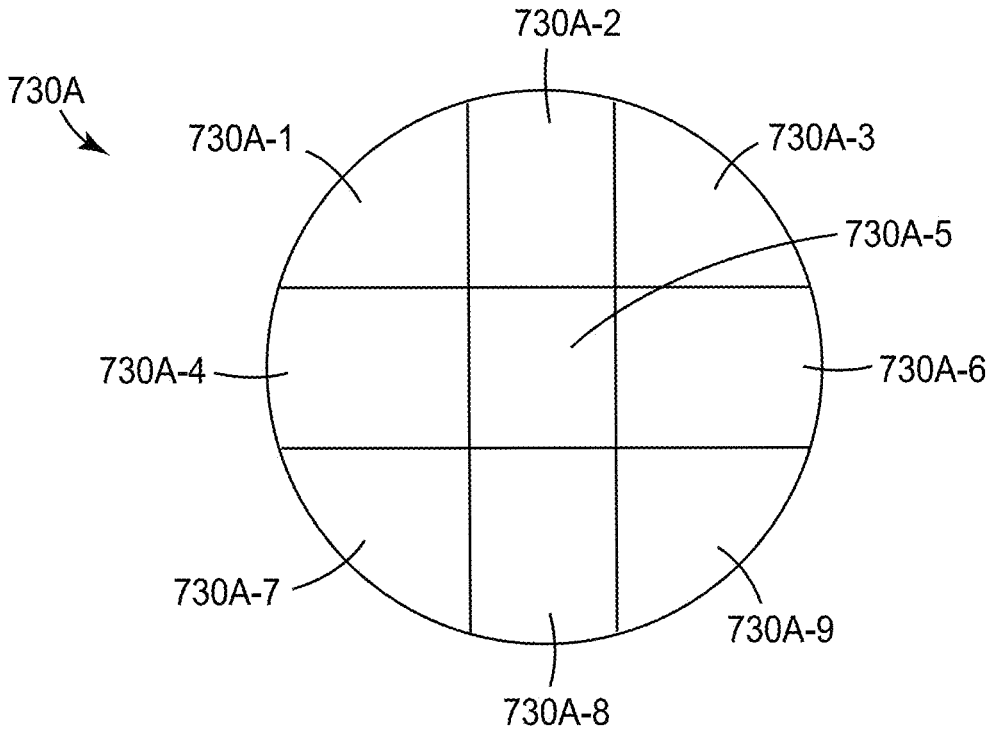
FIGS. 7A-7C are top views of switchable diffusers.
Figure 7B:
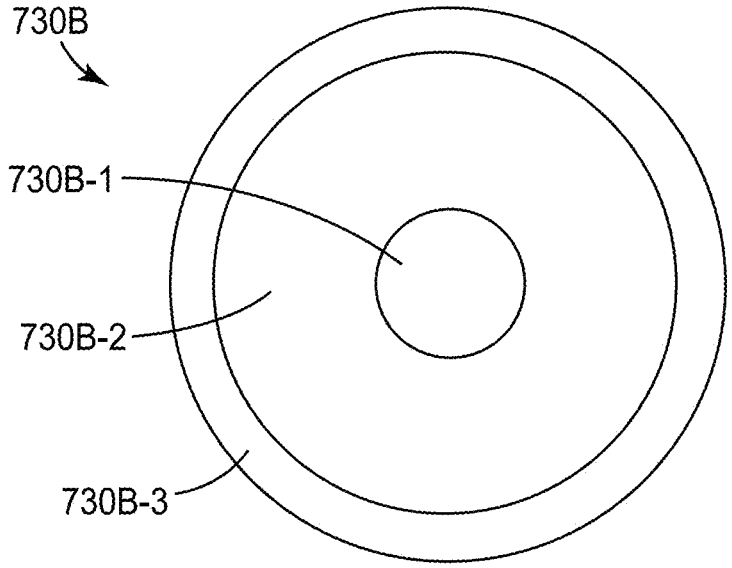
Figure 7C:
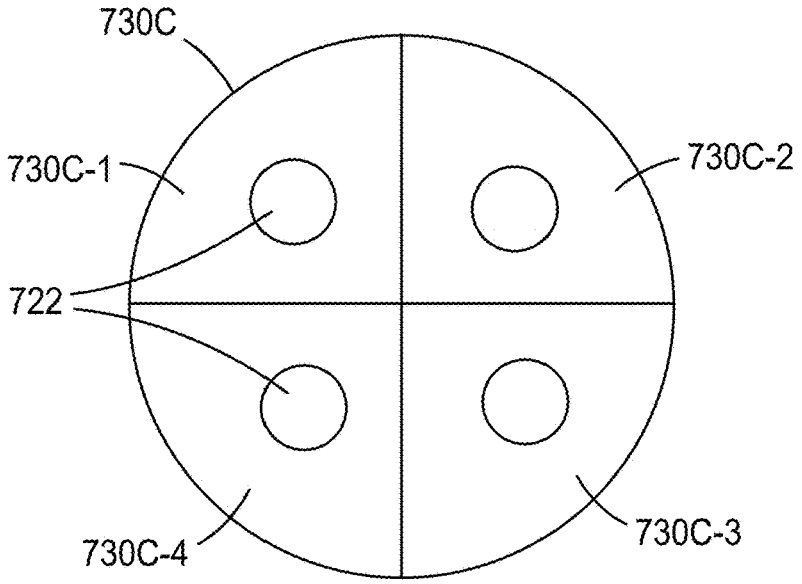

Any of the switchable diffusers of the present description may include a plurality of independently addressable regions. FIG. 7A is a top view of switchable diffuser 730A having first through ninth independently addressable regions 730A-1 through 730A-9. FIG. 7B is a top view of switchable diffuser 730B having first through third independently addressable regions 730B-1 through 730B-3. FIG. 7C is a top view of switchable diffuser 730C having first through fourth independently addressable regions 730C-1 through 730C-4. Switchable diffuser 730C is disposed above a light source having four LEDs which produce light on switchable diffuser 730C in areas 722. Each independently addressable region corresponds to an LED. Such an arrangement allows a useful degree of adjustability of the light output of a lighting component. The LEDs may have different spectral power distribution functions (e.g., the LEDs may be differently colored LEDs) or they may all have substantially the same spectral power distribution function (e.g., all LEDs may have the same color which may be white). If the LEDs are differently colored LEDs, switchable diffuser 730C may be used to control the output distribution of the various colors which can produce differently tinted light output in different directions. This may be useful in various lighting applications such as, for example, stage lighting. Although four LEDs and four addressable regions are illustrated in FIG. 7C, any number of LEDs and any number of independently addressable regions may be used. In some embodiments, the switchable diffuser may be registered with a plurality of LEDs, but there may or may not be a 1-to-1 correspondence with the number of LEDs and the number or addressable regions of the switchable diffuser. For example, there may be two or more LEDs that correspond to a single region of the switchable diffuser.

Additional optical layers, such as a segmented layer, may be disposed adjacent a switchable diffuser as described further elsewhere. In some embodiments, a segmented layer is disposed adjacent the switchable diffuser and aligned with the independently addressable regions of the switchable diffuser. The segmented layer may have multiple segments that each produces an optical effect. In some embodiments, the switchable diffuser and the segmented layer may be registered with LEDs (as is FIG. 7C, for example) with each segment tailoring the light output from its corresponding LED. For example, the output distribution of a first LED after passing through the segmented layer when the corresponding region of the switchable diffuser is in a substantially clear state may have a substantially circular distribution (in a plane parallel to the switchable diffuser), while the output distribution of a second LED after passing through the segmented layer when the corresponding region of the switchable diffuser is in a substantially clear state may have an elliptical distribution (in a plane parallel to the switchable diffuser). The segmented layer may have a replicated pattern (e.g., microreplicated) that varies in different segments of the layer. Suitable materials that can be used in a segmented layer include, for example, the diffusers available from Luminit, LLC (Torrance, Calif.) which may utilize surface relief holograms. The combination of a switchable diffuser and a segmented layer where independently addressable regions of the switchable diffuser is in registration with the segmented layer and in registration with a plurality of LEDs allows for a high degree of tunability to the light output of a lighting component.

Although nine, three and four independently addressable regions are shown in FIGS. 7A-7C, respectively, any number of independently addressable regions may be used. For example, a switchable diffuser may have an x-y grid of independently addressable regions that includes at least 10, or at least 100 independently addressable regions. This may be useful for embodiments having at least one reflective or transflective surface shaped such that light from the light injection region that passes through a position in the x-y grid is reflected into a particular direction. Having an x-y grid of independently addressable regions may allow a high degree of adjustability to angular, spectral, and/or polarization output distribution from the lighting component.

Figure 7D:
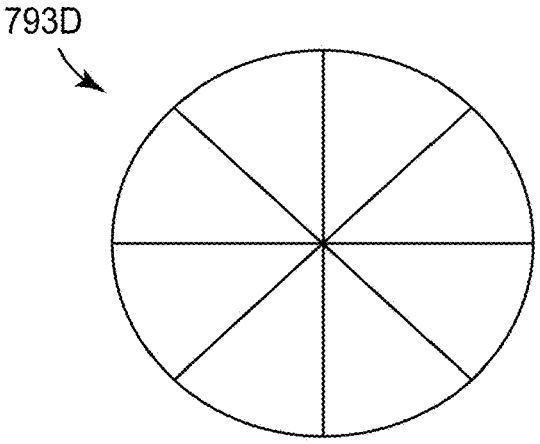
FIGS. 7D-7E are top views of electrodes.
Figure 7E:
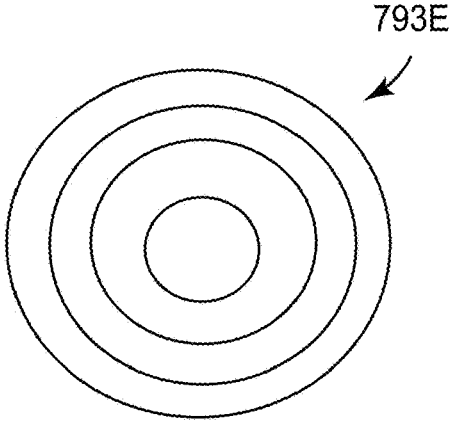
Figure 7F:
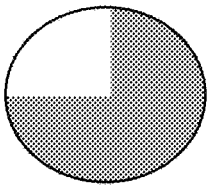
FIGS. 7F-7J are top views of switchable diffusers.
Figure 7G:
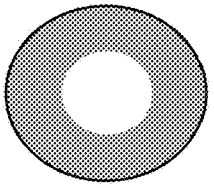
Figure 7H:
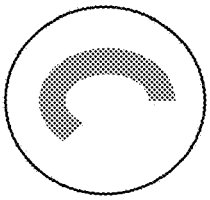
Figure 7I:
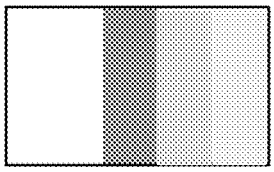
Figure 7J:
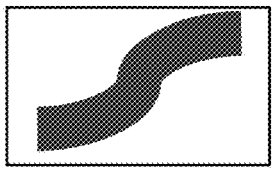

Electrodes that may be used to construct a switchable diffuser having a plurality of independently addressable regions are illustrated in FIGS. 7D-7E. Electrode 793D includes eight wedge shaped independently addressable sections and electrode 793E includes four independently addressable sections arranged in a concentric circle pattern. Each of the electrodes 793E or 793D may be used in a liquid crystal based switchable diffuser, for example, in combination with an unpatterned electrode or may be used in combination with a patterned electrode. For example, electrodes 793E and 793D may be used as opposing electrodes in a switchable diffuser to produce a variety of haze patterns such as those illustrated in FIG. 7F-7H. Alternate electrode geometries can be used to produce the haze patterns shown in FIG. 7I or FIG. 7J. FIGS. 7F-7J illustrate haze patterns that can be generated at any particular time. The haze patterns produced by a switchable diffuser can be changed dynamically to produce a sequence of haze states. For example, the switchable diffuser can sequentially change states to produce a desired time-dependent light output.

In some embodiments, the switchable diffuser uses a bistable liquid crystal as described elsewhere. This allows, for example, the serpentine hazy state illustrated in FIG. 7J to be an "off" state, i.e., a state that is stable when no power is applied. This may be used, for example, in a lighting component that produces indicia, such as a company logo, when the switchable diffuser is in an off state. Depending on the intended application, the hazy state that produces the indicia may be a low haze state so that the indicia is only faintly produced or may be a higher haze state that produces the indicia with stronger contrast.

Figure 7K:
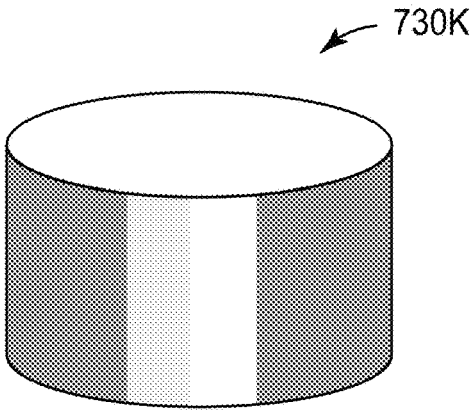
FIG. 7K is a perspective view of a switchable diffuser.

The switchable diffusers and electrodes illustrated in FIGS. 7A-7J are shown as having a planar geometry. It should be realized that other geometries are possible, including curved geometries. In some embodiments, the switchable diffuser is curved such that a cross section of the switchable diffuser is a closed curve. For example, the switchable diffuser may have a cylindrical shape. This is illustrated in FIG. 7K which shows switchable diffuser 730K having a substantially cylindrical shape and having regions in various states. The switchable diffuser may be patterned in horizontal or vertical stripes or any other patterning may be used. In other embodiments, the switchable diffuser may have a compound curve shape, such as a dome shape, for example.

Figure 7L:
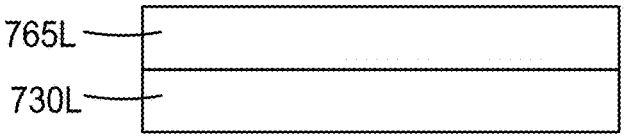
FIGS. 7L-7M are cross-sectional views of a switchable diffuser with additional optical elements.
Figure 7M:
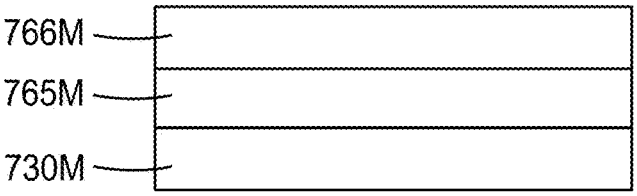

It may be desirable to use additional optical elements, such as additional diffusers, in addition to a switchable diffuser to tailor the light output of a lighting component. In some embodiments, an additional optical element or elements may be included in an optical volume and may be disposed adjacent the switchable diffuser. This is illustrated in FIG. 7L which shows additional optical element 765L disposed adjacent to first switchable diffuser 730L and in FIG. 7M which shows additional optical elements 765M and 766M adjacent first switchable diffuser 730M. The additional element(s) may be a static (non-switchable) element, such as a light redirecting element, a spectrally selective absorber, a polarizer (reflective or absorptive), or a static diffuser. These elements can be positioned before (i.e., facing the light injection region) and/or after (i.e., opposite the light injection region) the switchable diffuser. For example, a first polarizer can be placed before the switchable diffuser and a second polarizer can be placed after the switchable diffuser. The additional element or elements may also be a second switchable diffuser. If two switchable diffusers are used, the first and second switchable diffuser may have similar or different geometries for the respective independently addressable regions. The overlap of diffuse areas of the two diffusers may be complete or substantially complete, partial, or none or substantially none. The two switchable diffusers may be in registration or may be unregistered. In some embodiments, the first switchable diffuser 730L has a plurality of independently addressable regions and the additional optical element 765L is a static optical element which has a spatial variation (e.g., it may be segmented) and is in registration with the first switchable diffuser 730L. In some embodiments, one of the additional optical elements 765M and 766M is a static element and the other is a second switchable diffuser. One or both of the switchable diffusers may have independently addressable regions and the static element may have a spatial variation and may be in registration with one or both of the switchable diffusers.

In some embodiments, the first switchable diffuser (730L or 730M) is in registration with individual LEDs as illustrated in FIG. 7C, for example, while in other embodiments, the first switchable diffuser is not registered with LEDs. In some embodiments, the first switchable diffuser (730L or 730M) is in registration with individual LEDs as illustrated in FIG. 7C, for example, and at least one additional optical element (e.g., additional optical element 765L, 765M, or 766M) is a static optical element having a plurality of segments in registration with the first switchable diffuser and with individual LEDs. The at least one additional optical element may be a segmented layer having differing microstructures in differing segments as described further elsewhere.

In any of the embodiments described herein, additional optical elements, such as additional diffusers, may be at least partially disposed within the optical volume. An additional diffuser may be a switchable diffuser or may be a non-switchable diffuser. In some embodiments, a non-switchable diffuser may be disposed adjacent a switchable diffuser. In some embodiments, an additional optical element, such as a non-switchable diffuser, may be disposed in the optical volume at a distance from a switchable diffuser and/or with a different orientation than the switchable diffuser. In some embodiments, a plurality of switchable diffusers is disposed at least partially within the optical volume. In some embodiments, additional optical elements, such as an additional diffuser, may be disposed outside the optical volume.

Figure 8:
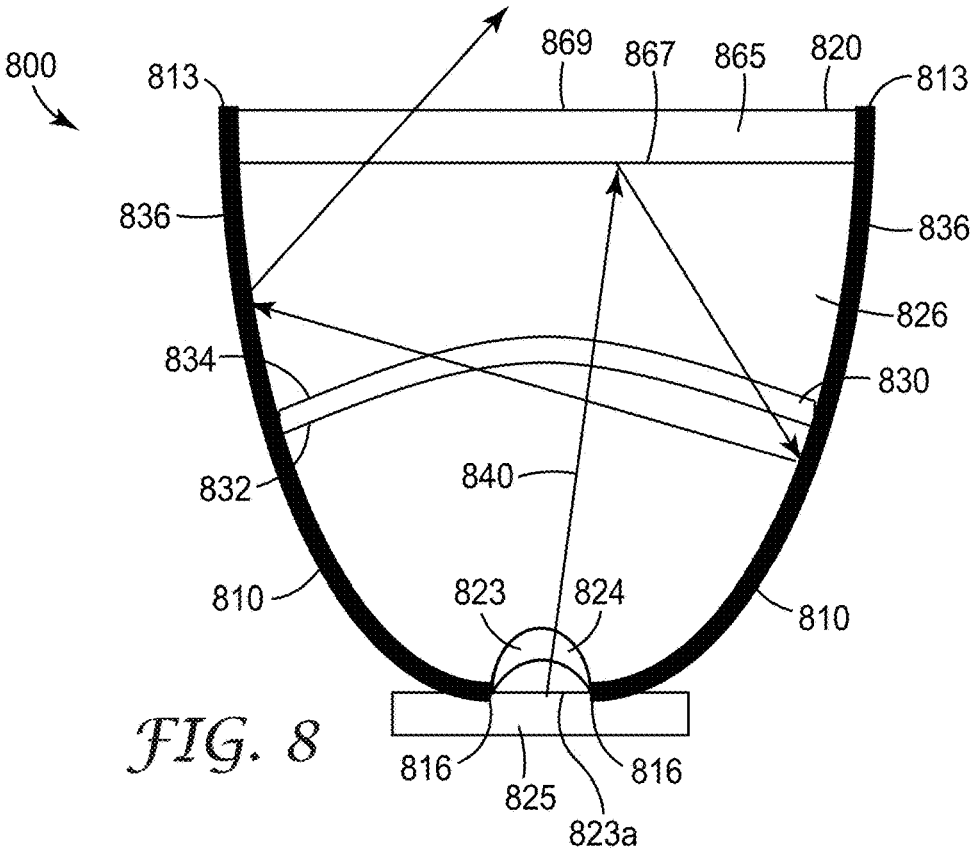

FIG. 8 shows a cross-sectional views of lighting component 800 including at least one reflective or transflective outer major surface 810 having at least one distal edge 813 and at least one proximal edge 816, output major surface 820, light injection region 823, lens component 824, light source 825, optical volume 826, and first switchable diffuser 830 disposed in optical volume 826. First switchable diffuser 830 includes first major surface 832 and second major surface 834. Lighting component 800 also includes additional optical element 865 having first major surface 867 and opposing second major surface 869. Output major surface 820 is a distal surface adjacent the at least one distal edge 813 of the at least one reflective or transflective outer major surface 810. In the illustrated embodiment, the additional optical element 865 is disposed so that second major surface 869 is flush with the at least one distal edge 813 and so that the second major surface 869 forms the output major surface 820. In other embodiments, the additional optical element 865 is positioned below the at least one distal edge 813 so that the output major surface 820 is above the second major surface 869. In still other embodiments, an additional diffuser may extend beyond the at least one distal edge 813.

Additional optical element 865 may be a static element, such as a light redirecting element, a spectrally selective absorber, a polarizer, or a non-switchable diffuser. The additional optical element 865 may also be a second switchable diffuser. First switchable diffuser 830 may include a plurality of independently addressable regions. Additional optical element 865 may be a second switchable diffuser that includes a plurality of independently addressable regions. Additional optical element 865 may be a non-switchable diffuser having a haze that may be spatially varying or may be substantially uniform. First switchable diffuser 830 may have a surface normal that is not parallel to an optical axis of optical volume 826, at least in some portions, as described elsewhere.

Light injection region 823 is adjacent the at least one proximal edge 816 of the at least one reflective or transflective outer major surface 810. In the illustrated embodiment, light injection region 823 is a volume including lens component 824. Light injection region 823 includes an input surface 823*a*. In some embodiments, light injection region 823 is an input surface 823*a* adjacent the at least one proximal edge 816 and the light source 825 and lens component 824 are positioned outside of the optical volume 826. In some embodiments, light source 825 may include one or more individual lighting elements (e.g., one or more LEDs) and may extend into optical volume 826.

The at least one reflective or transflective outer major surface 810 includes a portion 836 opposite the first switchable diffuser 830 from light injection region 823. Portion 836 extends from the first switchable diffuser 830 to the at least one distal edge 813. In some embodiments, the at least one reflective or transflective outer major surface 810 is a single surface (corresponding to surface 110 in FIGS. 1A-1B) and in some embodiments, the at least one reflective or transflective outer major surface 810 is two surfaces (corresponding to surfaces 210 and 211 in FIGS. 2A-2B). In other embodiments, the at least one reflective or transflective outer major surface 810 includes more than two surfaces. Portion 836 may also be a single surface, two surfaces or more than two surfaces. The at least one reflective or transflective outer major surface 810 may have a spatially varying reflective property as described elsewhere.

Lighting component 800 includes a light path 840 extending from light injection region 823 to output major surface 820 and including a plurality of passes through first switchable diffuser 830. Light path 840 passes through first switchable diffuser 830, reflects from first major surface 867 of additional optical element 865, pass again through first switchable diffuser 830, reflects from the at least one reflective or transflective outer major surface 810, passes again through first switchable diffuser 830, reflects again from the at least one reflective or transflective outer major surface 810, passes through additional optical element 865 and exits through output major surface 820. Light path 840 does not include any reflections from output major surface 820 and does not include any portions or segments that pass into optical volume 826 from a region outside optical volume 826. Light path 840 does not include Fresnel surface reflections from first switchable diffuser 830.

In some embodiments, lighting component 800 is substantially hollow except for optical elements in light injection region 823, first switchable diffuser 830, and additional optical element 865. In some embodiments, lighting component 800 is substantially monolithic except for optical components in light injection region 823, first switchable diffuser 830, and additional optical element 865.

Figure 9:
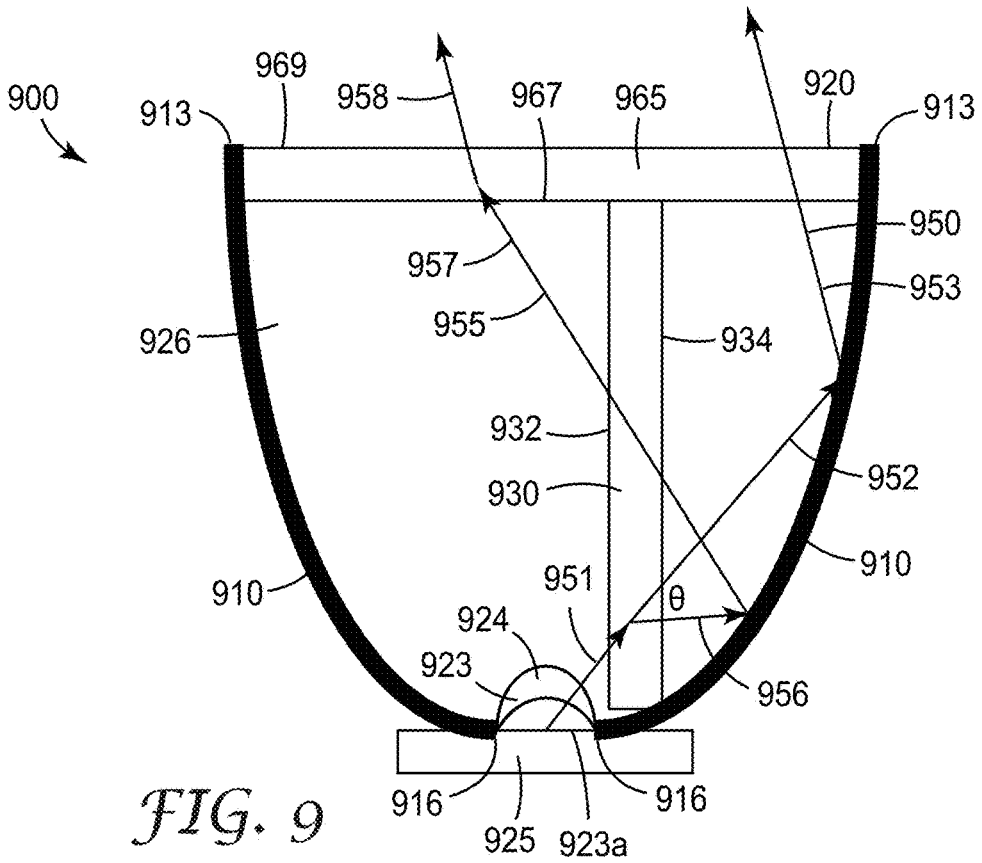

FIG. 9 shows a cross-sectional views of lighting component 900 including at least one reflective or transflective outer major surface 910 having at least one distal edge 913 and at least one proximal edge 916, output major surface 920, light injection region 923, lens component 924, light source 925, optical volume 926, and first switchable diffuser 930 disposed in optical volume 926. First switchable diffuser 930 includes first major surface 932 and second major surface 934. Lighting component 900 also include additional optical element 965 having first major surface 967 and opposing second major surface 969. Output major surface 920 is a distal surface adjacent the at least one distal edge 913 of the at least one reflective or transflective outer major surface 910. In the illustrated embodiment, the additional optical element 965 is disposed so that second major surface 969 is flush with the at least one distal edge 913 and so that the second major surface 969 forms the output major surface 920. In other embodiments, the additional optical element 965 is positioned below the at least one distal edge 913 so that the output major surface 920 is above the second major surface 969. In still other embodiments, an additional diffuser may extend beyond the at least one distal edge 913.

Additional optical element 965 may be a static element, such as a light redirecting element, a spectrally selective absorber, a polarizer, or a non-switchable diffuser. The additional optical element 965 may also be a second switchable diffuser. First switchable diffuser 930 may include a plurality of independently addressable regions. Additional optical element 965 may be a second switchable diffuser that includes a plurality of independently addressable regions. Additional optical element 965 may be a non-switchable diffuser having a haze that may be spatially varying or may be substantially uniform.

Light injection region 923 is adjacent the at least one proximal edge 916 of the at least one reflective or transflective outer major surface 910. In the illustrated embodiment, light injection region 923 is a volume including lens component 924. Light injection region 923 includes an input surface 923*a*. In some embodiments, light injection region 923 is an input surface 923*a* adjacent the at least one proximal edge 916 and the light source and lens are positioned outside of the optical volume 926. In some embodiments, light source 925 may include one or more individual lighting elements (e.g., one or more LEDs) and may extend into optical volume 926.

In some embodiments, the at least one reflective or transflective outer major surface 910 is a single surface (corresponding to surface 110 in FIGS. 1A-1B) and in some embodiments, the at least one reflective or transflective outer major surface 910 is two surfaces (corresponding to surfaces 210 and 211 in FIGS. 2A-2B). In other embodiments, the at least one reflective or transflective outer major surface 910 includes more than two surfaces. In other embodiments, the at least one reflective or transflective outer major surface 910 has a spatially varying reflective property as described elsewhere.

Lighting component 900 includes light path 950, which includes first, second and third segments 951, 952 and 953, and includes light path 955, which includes the first segment 951 and includes a second, third and fourth segments 956, 957 and 958. Light path 950 starts from light injection region 923 and extends through output major surface 920. Light path 950 does not include any reflections from output major surface 920, does not include any portions or segments that pass into optical volume 926 through output major surface 920 from a region outside optical volume 926, and does not include backscattering from the first switchable diffuser 930. First segment 951 starts at light injection region 923 and ends at first switchable diffuser 930. For light path 950, first segment 951 is transmitted through switchable diffuser substantially without scattering as second segment 952. This may occur, for example, when the switchable diffuser is in a first state which may be a characterized by a first haze. In some embodiments, the first state is a substantially clear state and the first haze is substantially zero. Second segment 952 reflects from the at least one reflective or transflective outer major surface 910 as third segment 953 which passes through additional optical element 965 and exits the optical volume 926 through output major surface 920.

For light path 955, first segment 951 is scattered with a scattering angle θ less than 90 degrees as it is transmitted through first switchable diffuser 930 and becomes second segment 956 which is reflected from the at least one reflective or transflective outer major surface 910 as third segment 957. Third segment passes through first switchable diffuser 930 and scatters and becomes fourth segment 958 as it passes through additional optical element 965. Fourth segment 958 exits optical volume 926 through output major surface 920. The scattering of light path 955 by first switchable diffuser 930 may occur, for example, when the switchable diffuser is in a second state which may be a characterized by a second haze different from the first haze. For example, the second haze may be significantly greater than the first haze. Light path 955 does not include backscattering from first switchable diffuser 930 and does not include Fresnel surface reflections from first switchable diffuser 930, though other light paths may include backscattering or Fresnel surface reflections. Light path 955 includes two passes through first switchable diffuser 930.

The at least one reflective or transflective surface may be linear or curved or may have portions which are linear and portions which are curved. Useful shapes may include cones, parabolas, or irregular shapes. In some embodiments, at least one reflective or transflective surface defines opposing boundaries of an optical volume. In some embodiments, a switchable diffuser may be disposed in the optical volume with an arbitrary orientation relative to the at least one reflective or transflective surface.

Figure 10:
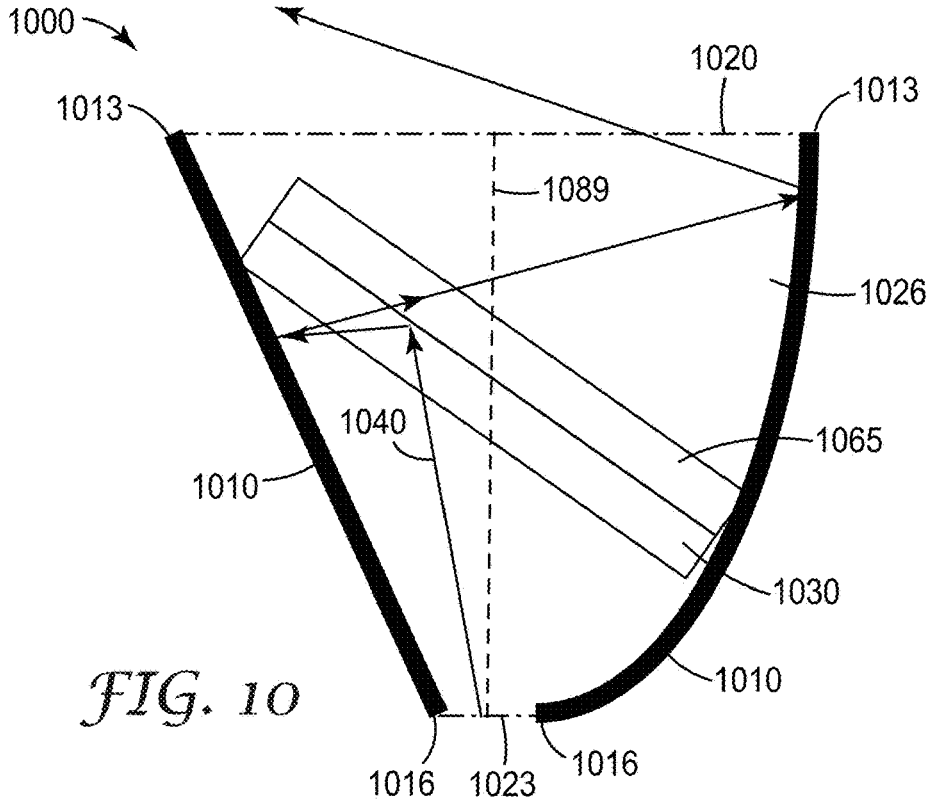

FIG. 10 shows lighting component 1000 including at least one reflective or transflective outer major surface 1010 having at least one distal edge 1013 and at least one proximal edge 1016, distal surface 1020, which is an output major surface, and input surface 1023, which is a light injection region for lighting component 1000. The at least one reflective or transflective outer major surface 1010 defines opposing boundaries of optical volume 1026. Optical volume 1026 has an optical axis 1089 extending from a centroid of input surface 1023 to a centroid of distal surface 1020. First switchable diffuser 1030 is disposed within the optical volume 1026. Lighting component 1000 also includes an additional optical element 1065 disposed adjacent (in this case immediately adjacent) first switchable diffuser 1030. In the illustrated embodiment, the additional optical element 1065 is above first switchable diffuser 1030. In other embodiments, the additional optical element 1065 is disposed below first switchable diffuser 1030. Lighting component 1000 includes light path 1040 extending from the input surface 1023 to the distal surface 1020. Light path 1040 includes two passes through first switchable diffuser 1030. Additional optical element 1065 may be any of the static or switchable optical elements described elsewhere.

In some embodiments, the at least one reflective or transflective outer major surface is a single continuous surface (for example, a cone shape). In some embodiments, the at least one reflective or transflective outer major surface is two opposing surfaces where each of the two surfaces are single continuous surfaces (for example, two planar surfaces separated from each other). In some embodiments, the at least one reflective or transflective surface defines opposing boundaries of the optical volume that include separated portions as illustrated in FIG. 11.

Figure 11:
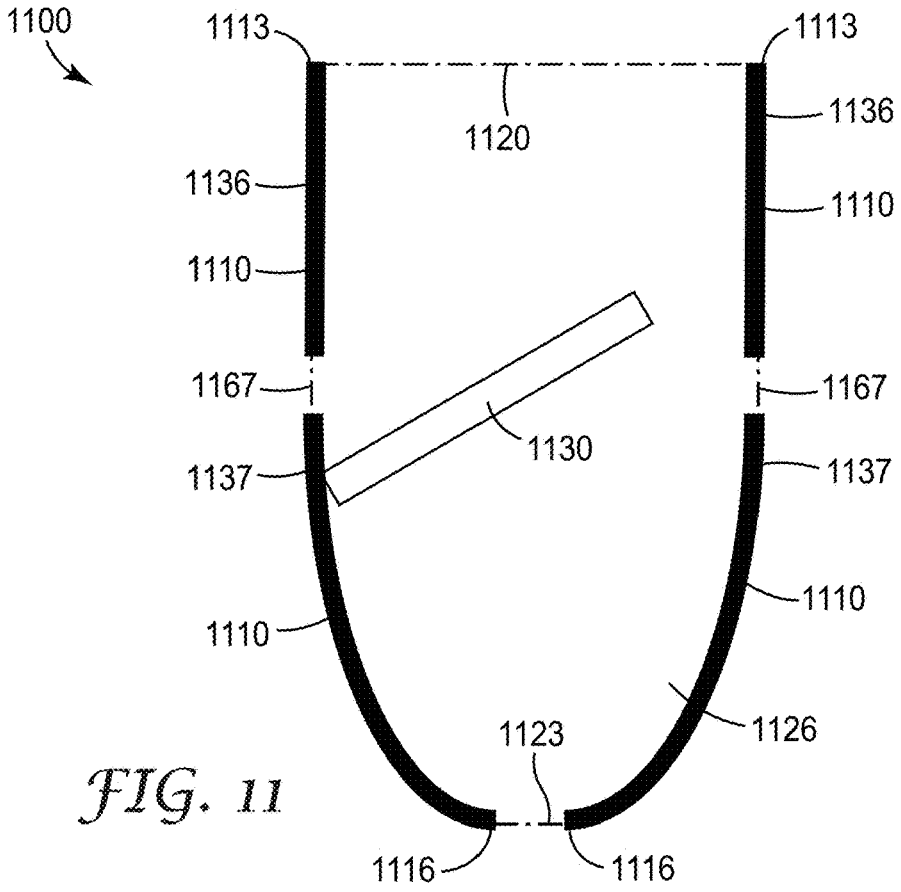

FIG. 11 shows lighting component 1100 including at least one reflective or transflective outer major surface 1110 having at least one distal edge 1113 and at least one proximal edge 1116, distal surface 1120, which is an output major surface, and input surface 1123, which is a light injection region for lighting component 1100. The at least one reflective or transflective outer major surface 1110 defines opposing boundaries of optical volume 1126. Switchable diffuser 1130 is disposed within the optical volume 1126. The at least one reflective or transflective outer major surface 1110 includes portion 1136 opposite switchable diffuser 1130 from input surface 1123, and includes portion 1137 between switchable diffuser 1130 and input surface 1123. Portion 1136 may include multiple segments (for example, if lighting component 1100 has a top view similar to that of FIG. 2B) or may include a single segment (for example, if lighting component 1100 has a top view similar to that of FIG. 1B). Similarly, portion 1037 may include multiple segments (for example, if lighting component 1100 has a top view similar to that of FIG. 2B) or may include a single segment (for example, if lighting component 1100 has a top view similar to that of FIG. 1B). One or more segments 1167 of a boundary of optical volume 1126 may be planar segments (for example, if lighting component 1100 has a top view similar to that of FIG. 2B) or may be conical segments (for example, if lighting component 1100 has a top view similar to that of FIG. 2B). Using discrete portions such as portion 1136 and portion 1137 may be useful in constructing lighting component 1100. In the final assembly, segments 1167 may be smaller than illustrated in FIG. 11 so that portion 1136 and 1137 are touching or nearly touching. In some embodiments, switchable diffuser 1130 has a surface normal that is not parallel to an optical axis of optical volume 1126, at least in some portions of the switchable diffuser 1130.

In some embodiments, reflective or transflective outer major surface 1110 may have uniform or substantially uniform reflectance and/or transmittance, while in other embodiments the reflective or transflective outer major surface 1110 may have reflectance and/or transmittance properties that varies along the surface. The variation may be substantially continuous or discrete zones may have distinct reflectance and/or transmittance properties. The shape and/or the reflectance and/or transmittance properties of reflective or transflective outer major surface 1110 may be selected such that switching the switchable diffuser from a first state to a second state changes the angular distribution and/or the spectral distribution and/or the polarization distribution of light output from lighting component 1100. Switchable diffuser 1130 may have a plurality of independently addressable regions. The plurality of independently addressable regions of the switchable diffuser 1130 may be in correspondence with zones of the reflective or transflective outer major surface 1110, as described elsewhere.

Figure 12A:
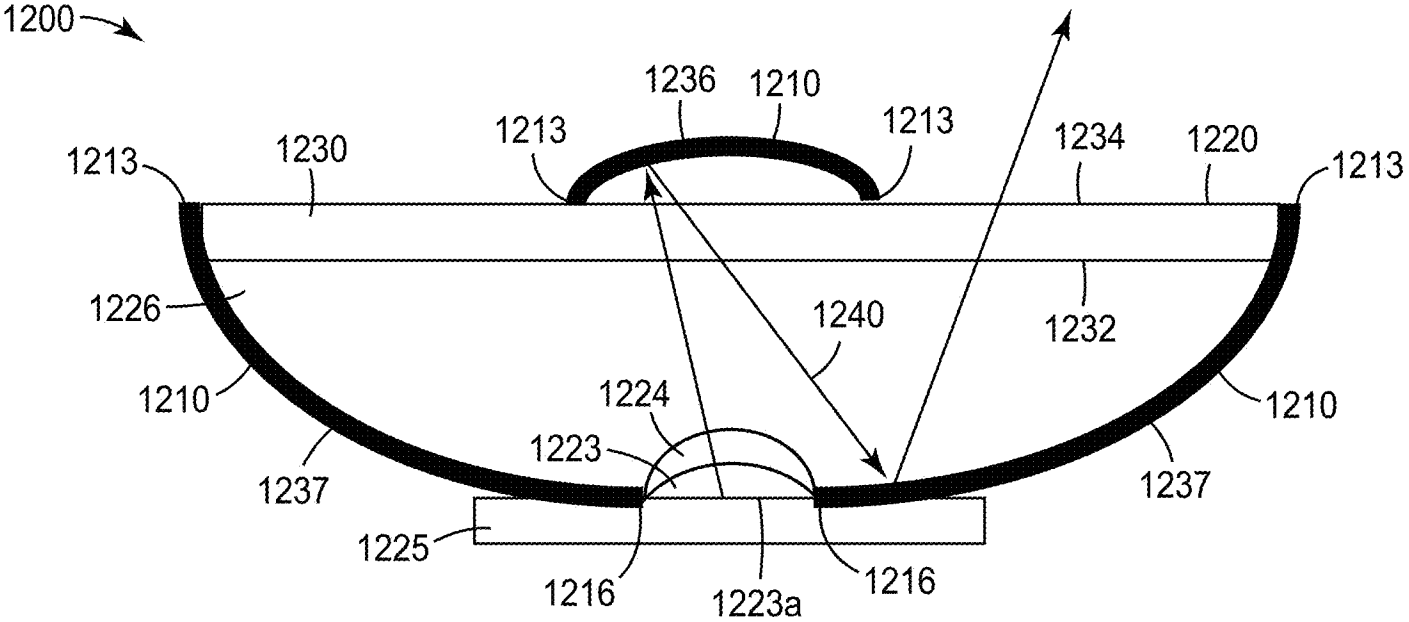

FIG. 12A shows a cross-sectional view of lighting component 1200 including at least one reflective or transflective outer major surface 1210 having at least one distal edge 1213 and at least one proximal edge 1216, distal surface 1220, which is an output major surface, and light injection region 1223. Light injection region 1223 includes input surface 1223*a* and lens component 1224. Light source 1225 is disposed to inject light into input surface 1223*a*. In some embodiments, light source 1225 may include one or more individual lighting elements (e.g., one or more LEDs) and may extend into optical volume 1226. The at least one reflective or transflective outer major surface 1210 defines opposing boundaries of optical volume 1226. Switchable diffuser 1230 is disposed within the optical volume 1226 and includes inner major surface 1232 and outer major surface 1234. Distal surface 1220 includes a portion of outer major surface 1234.

Lighting component 1200 includes light path 1240 extending from light injection region 1223 to the distal surface 1220. Light path 1240 includes three passes through switchable diffuser 1230.

The at least one reflective or transflective outer major surface 1210 includes portion 1236 opposite switchable diffuser 1230 from input surface 1223*a*, and includes portion 1237 between switchable diffuser 1230 and input surface 1223*a*. Portion 1236 is physically separate from portion 1237. Portion 1237 may include multiple segments (for example, if lighting component 1200 has a wedge shape similar to that of lighting component 1200B of FIG. 12B) or may include a single segment (for example, if lighting component 1200 has a cylindrical or axially-symmetric shape similar to that of lighting component 1200C of FIG. 12C).

Figure 12B:
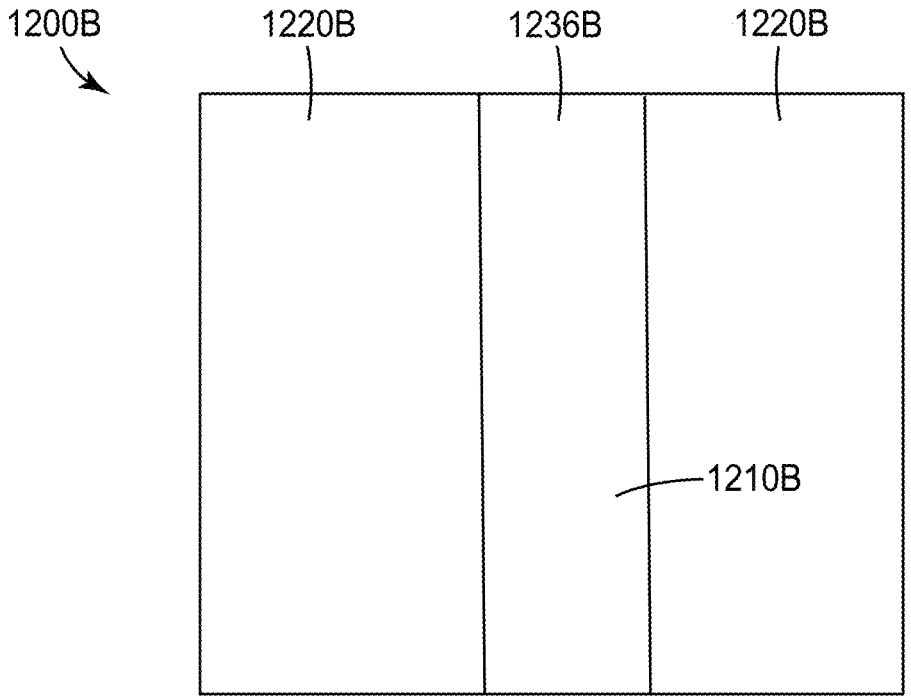
FIG. 12B-12C are top views of lighting components.

In some embodiments, distal surface 1220 includes separate segments on each side of portion 1236. This is illustrated in FIG. 12B which shows a top view of lighting component 1200B having distal surface 1220B which includes separate segments (which in this case are substantially rectangular) on each side of portion 1236B of at least one reflective or transflective outer major surface 1210B. Lighting component 1200B has a cross-sectional view corresponding to that of FIG. 12A. Lighting component 1200B can be described as having at least one reflective or transflective outer major surface 1210B that includes a first surface (corresponding to the left hand side of portion 1237 in FIG. 12A) that extends from the light injection region to the distal surface 1220B, an opposing second surface (corresponding to the right hand side of portion 1237 in FIG. 12A) that extends from the light injection region to the distal surface 1220B, and a third surface corresponding to portion 1236B disposed adjacent the distal surface 1220B opposite the light injection region.

Figure 12C:
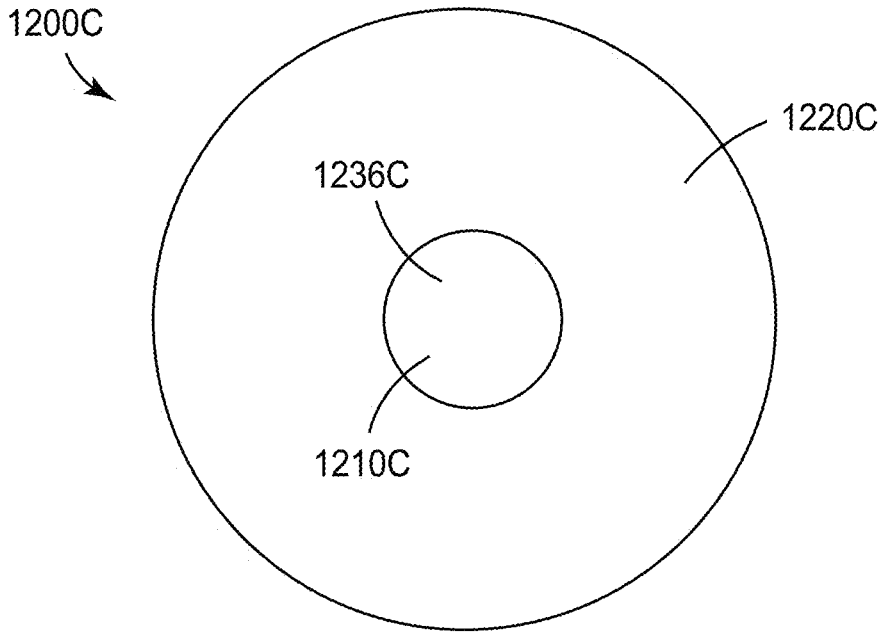

In some embodiments, distal surface 1220 includes a single segment surrounding portion 1236. This is illustrated in FIG. 12C which shows a top view of lighting component 1200C having distal surface 1220C which is substantially an annulus surrounding portion 1236C of at least one reflective or transflective outer major surface 1210C. Lighting component 1200C has a cross-sectional view corresponding to that of FIG. 12A. Lighting component 1200C can be described as having at least one reflective or transflective outer major surface 1210C that includes that includes a first axially symmetric surface (corresponding to portion 1237 of FIG. 12A) extending from the light injection region to the distal surface 1220C. In other embodiments, portion 1237 forms an asymmetric, rather than axially symmetric, surface extending from the light injection region to the distal surface 1220C.

The at least one reflective or transflective outer major surface 1210 can include zones having differing reflective properties as described elsewhere. For example, portions 1236 and 1237 may have differing reflectivities or may provide differing surface scattering. Switchable diffuser 1230 may include a plurality of independently addressable regions. The plurality of independently addressable regions of the switchable diffuser 1230 may be in correspondence with zones of the reflective or transflective outer major surface 1210, as described elsewhere.

Figure 13A:
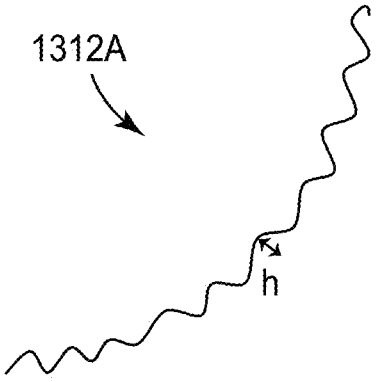
FIGS. 13A-13B are cross-sectional views of reflective or transflective surfaces.
Figure 13B:
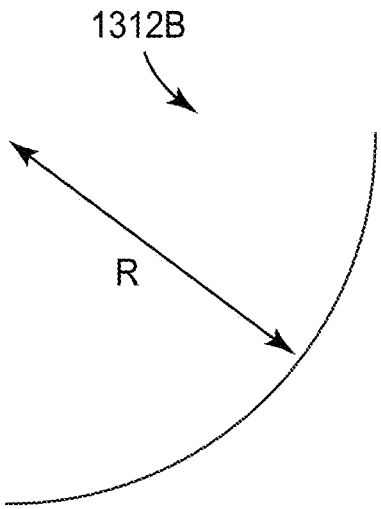
Figure 13C:
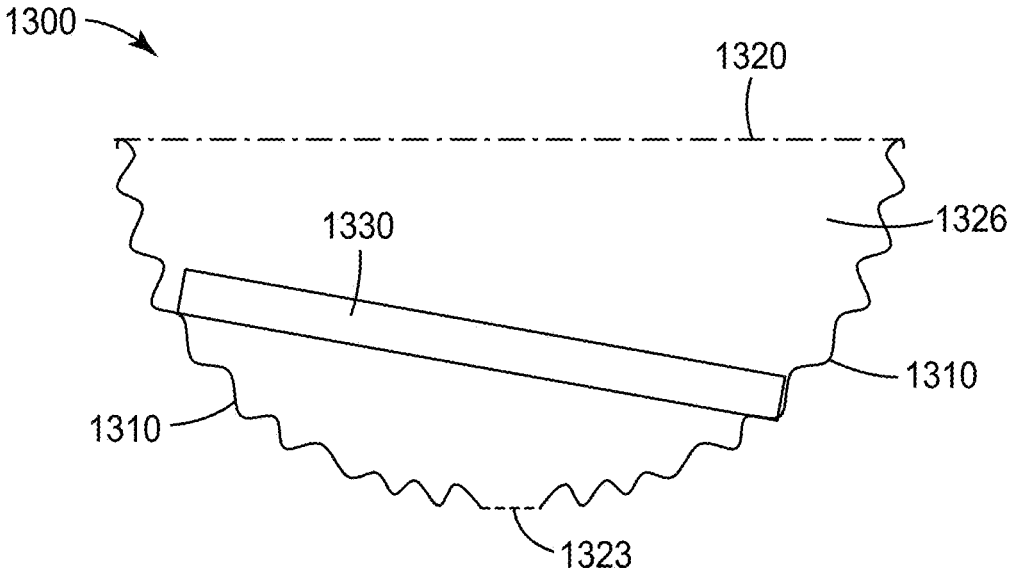
FIG. 13C is as cross-sectional view of a lighting component.

As used herein, the shape of the reflective or transflective surface refers to the overall shape of the surface and not to features incorporated into the reflective or transflective surface that are small compared to an overall radius of curvature of the surface. Such features may be considered small if they have a height or center-to-center spacing less than 10 percent, or less than 5 percent, or less than 2 percent of a radius of curvature of the overall shape of the surface. For example, the structured surface 1312A in FIG. 13A may be described as having the overall shape of surface 1312B of FIG. 13B since the feature size his small compared to the radius of curvature R. A reflective or transflective surface of a lighting component of the present description may have a shape corresponding to the structured surface 1312A. This is illustrated in lighting component 1300 of FIG. 13C. Lighting component 1300 includes at least one reflective or transflective outer major surface 1310 which includes a portion corresponding to structured surface 1312A. Lighting component 1300 also includes distal surface 1320, input surface 1323, and switchable diffuser 1330. The at least one reflective or transflective outer major surface 1310 may be said to be substantially monotonically diverging from the input surface 1323 to the distal surface 1320, which may be an output major surface. In some embodiments, the at least one reflective or transflective outer major surface 1312C defines opposing boundaries of the optical volume 1326 that substantially converge or diverge, but not both, from the light injection region, which may include input surface 1323, to the distal surface 1320.

Figure 14A:
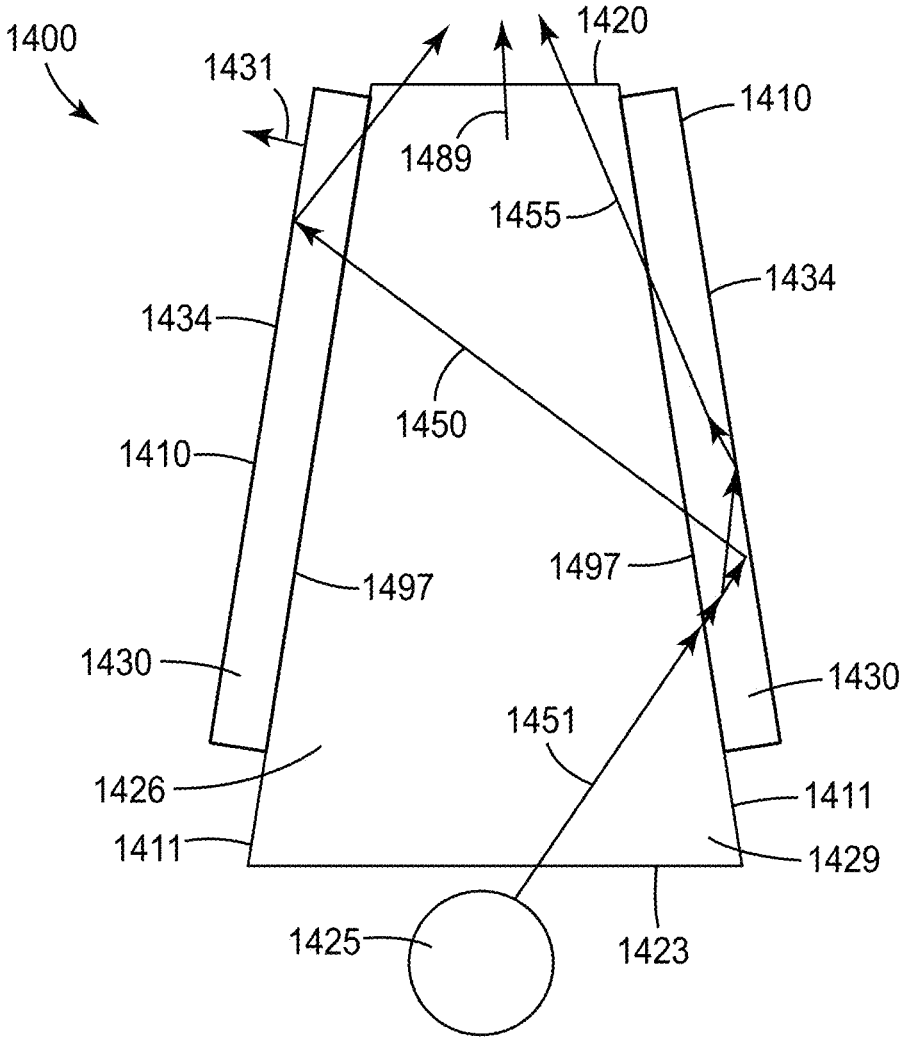
FIG. 14A is a cross-sectional view of a lighting component.

FIG. 14A shows a cross-sectional view of lighting component 1400 including at least one reflective or transflective outer major surface 1410, optional one or more additional surfaces 1411, distal surface 1420 which may be an output major surface, input surface 1423 which is a light injection region for lighting component 1400, light source 1425, optical volume 1426, transparent optical object 1429, at least one diffuser 1430 having at least one outer major surface 1434, light path 1450 including first segment 1451, and light path 1455 which also includes first segment 1451. Lighting component 1400 can be made by attaching at least one diffuser 1430 to the at least one sloping major surface 1497 of transparent optical object 1429.

Figure 14B:
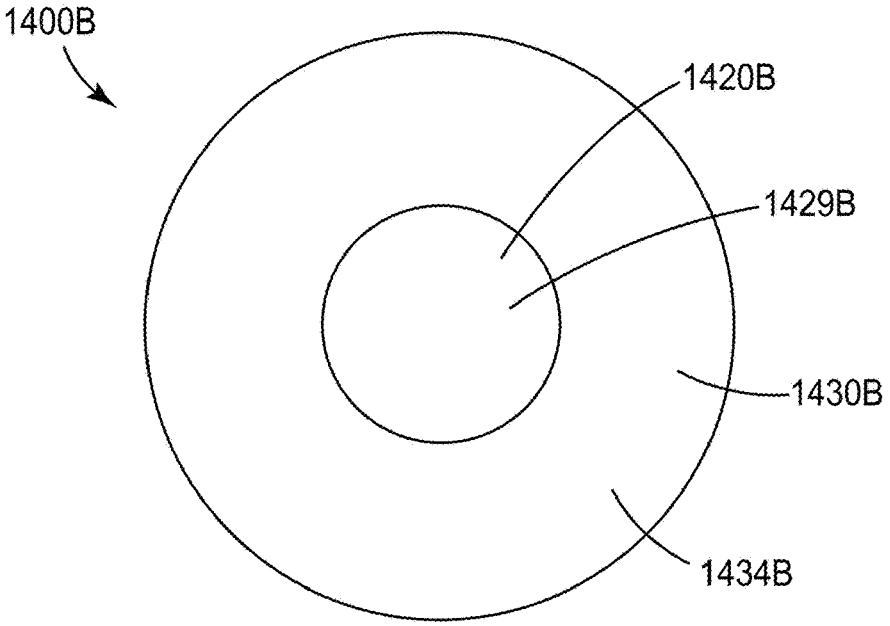
FIG. 14B-14C are top views of lighting components.
Figure 14C:
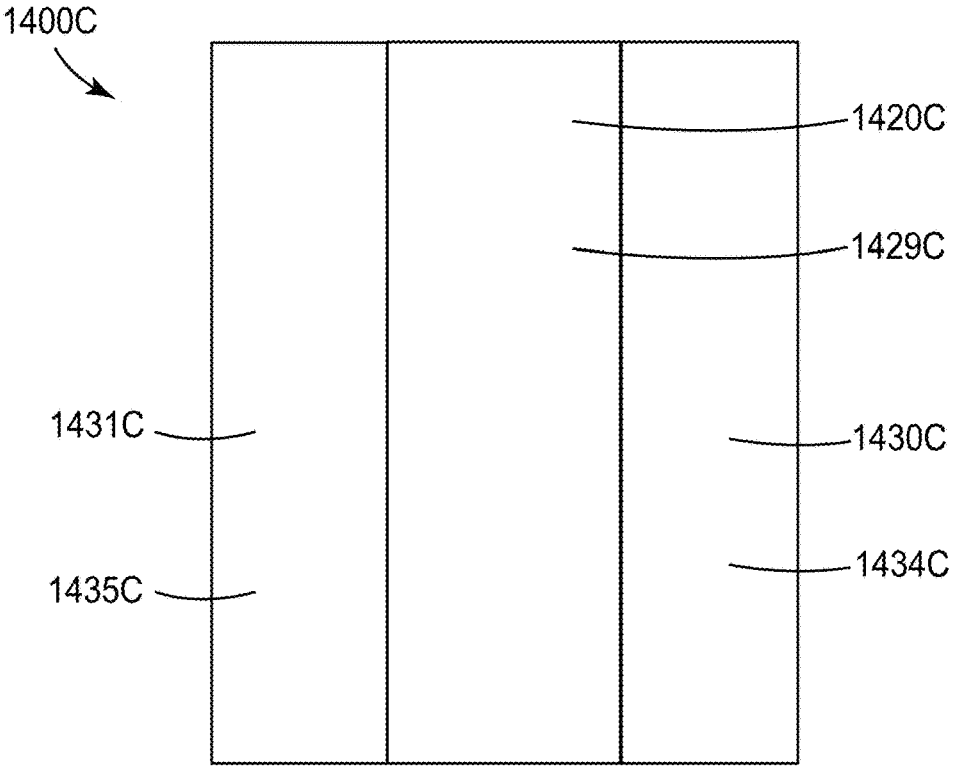

The transparent optical object 1429 may be substantially cylindrically symmetric or axially symmetric in which case the at least one diffuser 1430 may be a single diffuser that wraps around or wraps substantially around the transparent optical object 1429. The at least one reflective or transflective outer major surface 1410 may include a continuous surface encircling a cross-section of the transparent optical object 1429 and the at least one diffuser 1430 may include a switchable diffuser substantially covers the continuous surface. This is illustrated in FIG. 14B which shows a top view of lighting component 1400B corresponding to lighting component 1400 and including distal surface 1420B, transparent optical object 1429B and diffuser 1430B having outer major surface 1434B. Lighting component 1400B has a cross-sectional view substantially equivalent to that of lighting component 1400. Alternatively, the transparent optical object 1429 may be a wedge shaped object and the at least one diffuser 1430 may include two distinct diffusers on opposite sides of the transparent optical object 1429. This is illustrated in FIG. 14C which shows a top view of lighting component 1400C corresponding to lighting component 1400 and including distal surface 1420C, transparent optical object 1429C and at least one diffuser having at least one outer major surface. The at least one diffuser includes first and second diffusers 1430C and 1431C having first and second outer major surfaces 1434C and 1435C, respectively. Lighting component 1400C has a cross-sectional view substantially equivalent to that of lighting component 1400.

Lighting component 1400 includes at least one reflective or transflective outer major surface 1410 which includes at least one outer surface of the at least one diffuser 1430. The geometry of lighting component 1400 and the refractive index of the at least one diffuser 1430 are chosen such that at least a portion of light injected into input surface 1423 is reflected from the outer surface of the at least one diffuser 1430 through Total Internal Reflecting (TIR). Lighting component 1400 may include optional one or more additional surfaces 1411 which may be portions of a side or sides of transparent optical object 1429 that is not covered by the at least one diffuser 1430. In some cases, the optional one or more additional surfaces 1411 are major surfaces which are reflective or transflective. In such cases, the one or more reflective or transflective outer major surface 1410 may include the optional one or more additional surfaces 1411. In some embodiments, the at least one diffuser 1430 covers or substantially covers the surfaces of transparent optical object 1429 other than the input surface 1423 and the distal surface 1420 and possible minor surfaces. In such embodiments, optional one or more additional surfaces 1411 may be absent or may include only minor surfaces.

The at least one diffuser 1430 includes at least one switchable diffuser which may be a single switchable diffuser as in lighting component 1400B or may be a first switchable diffuser and a second diffuser that may be switchable or non-switchable. For example, first diffuser 1430C may be a first switchable diffuser and second diffuser 1431C may be a second switchable diffuser or may be a non-switchable diffuser. The at least one diffuser 1430 may include a plurality of independently switchable regions. The at least one diffuser 1430 may have a surface normal 1431 that is not parallel to an optical axis of optical volume 1426 and/or that is not parallel to the direction of average light output 1489 when the at least one switchable diffuser is in a spatially uniform state such as a substantially clear state. The direction of average light output 1489 when the at least one switchable diffuser is in a spatially uniform state such as a substantially clear state may correspond with an optical axis of the optical volume 1426.

Lighting component 1400 includes light path 1450 extending from input surface 1423 to distal surface 1420. Light path 1450 includes first segment 1451 between light source 1425 and the at least one sloping major surface 1497 of transparent optical object 1429. Light path 1450 is reflected twice from the at least one reflective or transflective outer major surface 1410 before exiting through distal surface 1420. Light path 1450 makes four passes (two on each side) through the at least one diffuser 1430 substantially without scattering. This may occur when the at least one diffuser 1430 is in a first state which may be a substantially clear state. Light path 1455 may occur when the at least one diffuser 1430 is in a second state which may be a hazy state. Light path 1455 includes first segment 1451, is scattered by the at least one diffuser 1430, reflects from the at least one reflective or transflective outer major surface 1410, is scattered again by the at least one diffuser 1430 and exits through distal surface 1420. Light path 1455 includes only one reflection from the at least one reflective or transflective outer major surface 1410 before exiting optical volume 1426 while light path 1450 includes two reflections from the at least one reflective or transflective outer major surface 1410 before exiting optical volume 1426. Light paths 1450 and 1455 start from light source 1425, pass through input surface 1423, and extend through distal surface 1420. Light paths 1450 and 1455 do not include any reflections from distal surface 1420 and do not include any portions or segments that pass into optical volume 426 through output major surface 420 from a region outside optical volume 1426.

Other light paths may exit the optical volume 1426 through the at least one outer major surface 1434 or through the optional one or more additional surfaces 1411. The proportion of light that exits optical volume 1426 though distal surface 1420 can be changed by changing the state of the at least one diffuser 1430. The light output from lighting component 1400 may have a first output distribution when the at least one diffuser 1430 is in a first state and may have a second output distribution different from the first output distribution when the at least one diffuser 1430 is in a second state.

At least one reflective or transflective outer major surface 1410 may have spatially varying reflective and/or transmissive properties. Such properties may include differing overall reflectance and/or transmittance of visible light, and/or differing wavelength dependent reflectance and/or transmittance, and/or or differing polarization dependent reflectance and/or transmittance. Differing distinct reflectance and/or transmittance properties can be achieved by using various MOF films as described elsewhere. For example, a perforated reflector film or a perforated reflective polarizer having variable perforation density may be positioned adjacent to the at least one outer major surface 1434 of the at least one diffuser 1430. The film or films may be attached using an optically clear adhesive or an air gap may separate the film or films from the at least one outer major surface 1434. Embodiments where additional reflective or transflective layers are positioned adjacent an outer major surface are further described elsewhere.

Transparent optical object 1429 may be a substantially monolithic optically clear component and optical volume 1426 may be substantially monolithic except for the at least one diffuser 1430. Transparent optical object 1429 may include at least one sloping major surface 1497 that substantially converges or diverges but not both from the input surface 1423 to the distal surface 1420.

Figure 15:
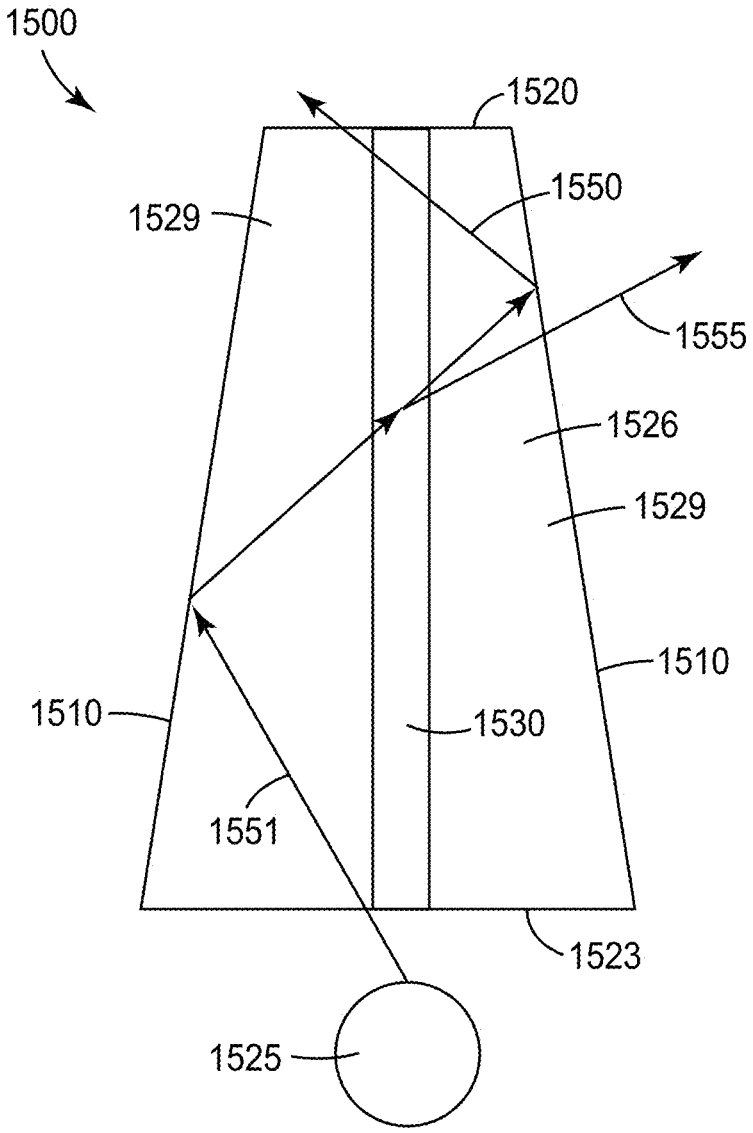
FIGS. 15-18 are cross-sectional views of lighting components.

FIG. 15 shows a cross-sectional view of lighting component 1500 including at least one reflective or transflective outer major surface 1510, distal surface 1520 which may be an output major surface, input surface 1523 which is a light injection region for lighting component 1500, light source 1525, optical volume 1526, at least one transparent optical object 1529, switchable diffuser 1530, light path 1550 having first segment 1551, and light path 1555 which also includes first segment 1551. In some embodiment, lighting component 1500 may have a substantially cylindrically or axially symmetric shape analogous to lighting component 1400B. In such embodiments, switchable diffuser 1530 may be disposed in a hollowed-out region of at least one transparent optical object 1529 which may be a single transparent optical solid. In some embodiment, lighting component 1500 may have a substantially wedge shape analogous to lighting component 1400C. In these embodiments, the at least one transparent optical object 1529 may include two separate wedges attached to opposing surfaces of the switchable diffuser 1530. The at least one reflective or transflective outer major surface 1510 includes at least one major surface of the at least one transparent optical object 1529. The at least one transparent optical object 1529 may be substantially monolithic or may include a plurality of substantially monolithic components. Optical volume 1526 may be substantially monolithic except for the switchable diffuser 1530.

Switchable diffuser 1530 may include a plurality of independently addressable regions. As described elsewhere, this may allow an improved degree of adjustability of the light output distribution. Switchable diffuser 1530 may have a surface normal that is not parallel to a direction of average light output when the switchable diffuser is in a substantially clear state. Switchable diffuser 1530 may have a surface normal that is orthogonal or substantially orthogonal to an optical axis of optical volume 1526 and/or to a direction of average light output when the switchable diffuser is in a substantially clear state.

Lighting component 1500 includes light path 1550 which includes first segment 1551 and undergoes TIR from at least one reflective or transflective outer major surface 1510 twice before exiting optical volume 1526 through distal surface 1520. First segment 1551 extends from light source 1525 to the first reflection from the at least one reflective or transflective outer major surface 1510. Light path 1550 is transmitted through switchable diffuser 1530 substantially without scattering and may occur when switchable diffuser 1530 is in a first state which may be a low haze state or a substantially clear state. Light path 1555 includes first segment 1551 and includes a reflection from at least one reflective or transflective outer major surface 1510, but is scattered as it is transmitted through the switchable diffuser 1530 so that it is subsequently incident on the at least one reflective or transflective outer major surface 1510 at an incidence angle below a critical angle for TIR and light path 1550 exits the optical volume 1526 through the at least one reflective or transflective outer major surface 1510. Light path 1555 includes only one reflection from the at least one reflective or transflective outer major surface 1510, while light path 1550 includes two such reflections.

The proportion of light that exits optical volume 1526 though distal surface 1520 can be changed by changing the state of the switchable diffuser 1530. The light output from lighting component 1500 may have a first output distribution when the switchable diffuser 1530 is in a first state and may have a second output distribution different from the first output distribution when the switchable diffuser 1530 is in a second state. The proportion of light that exits the optical volume through the distal surface when the switchable diffuser is in a substantially clear state can be increased by decreasing the taper of the at least one reflective or transflective outer major surface 1510. The at least one reflective or transflective outer major surface 1510 may define opposing boundaries of the optical volume 1526 which substantially converge from the light injection region 1523 to the distal surface 1520.

In some embodiments, an additional switchable diffuser is disposed between light source 1525 and optical volume 1526. When the additional switchable diffuser is in a substantially clear state, light from the light source 1525 enters optical volume 1526 with an angular distribution such that a substantially portion of the light is transmitted through the optical volume and exits optical volume 1526 though distal surface 1520. At least a portion of this light may be directed to distal surface 1520 through TIR from at least one reflective or transflective outer major surface 1510. When the additional switchable diffuser is in a hazy state, light from the light source 1525 is diffused before it reaches light injection region 1523. A first portion of this diffused light may be scattered by the additional switchable diffuser so that the first portion does not enter optical volume 1526. A second portion of the diffused light may enter optical volume 1526 at angles such that it does not TIR from the at least one reflective or transflective outer major surface 1510. A third portion of the diffused light may enter optical volume 1526 at angles such that it can propagate through optical volume 1526 and exit through distal surface 1520. The additional switchable diffuser thus provides an additional degree of control of the distribution of the light output. In alternative embodiments, the switchable diffuser 1530 is not included in optical volume 1526 and the distribution of the light output is adjusted by a switchable diffuser disposed between light source 1525 and optical volume 1526.

Figure 16:
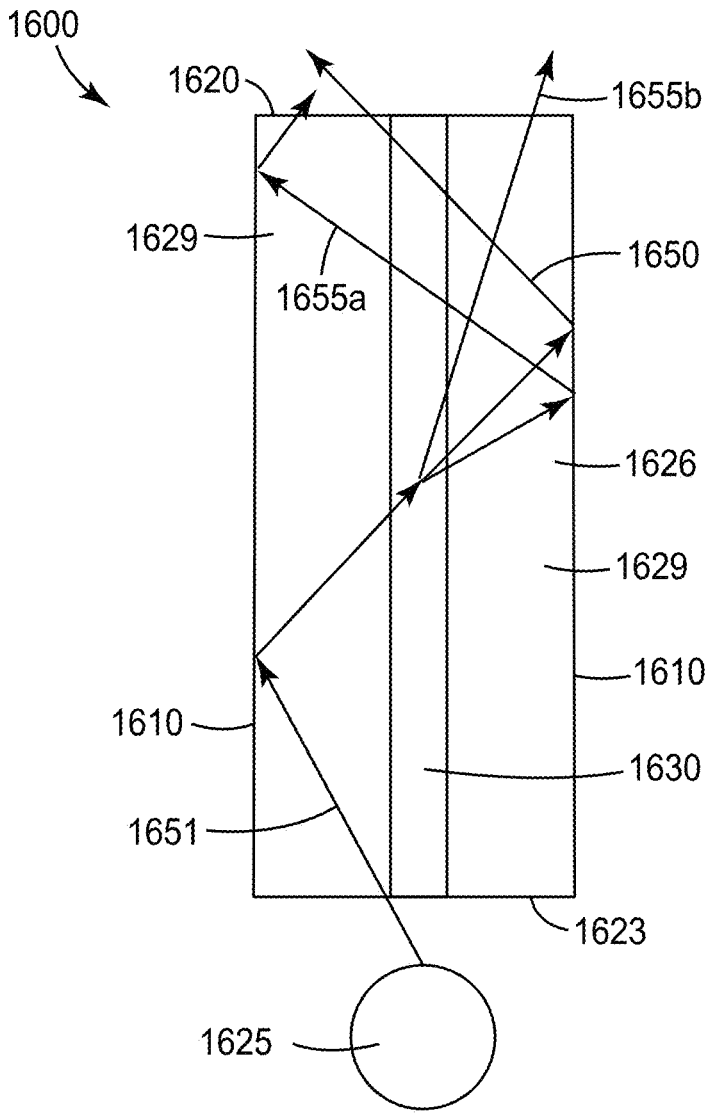

FIG. 16 shows a cross-sectional view of lighting component 1600 including at least one reflective or transflective outer major surface 1610, output major surface 1620, input surface 1623 which is a light injection region for lighting component 1600, light source 1625, optical volume 1626, at least one transparent optical object 1629, switchable diffuser 1630, light path 1650 having first segment 1651, light path 1655*a* which also includes first segment 1651, and light path 1655*b* which also includes first segment 1651. In some embodiments, lighting component 1600 may have a substantially cylindrical or axially-symmetric shape analogous to lighting component 1400B. In these embodiments, switchable diffuser 1630 may be disposed in a hollowed-out region of at least one transparent optical object 1629 which may be a single transparent optical solid. In some embodiments, lighting component 1600 may have a substantially rectangular (or rectangular parallelepiped) shape analogous to lighting component 1400C. In these embodiments, the at least one transparent optical object 1629 may include two separate wedges attached to opposing surfaces of the switchable diffuser 1630. The at least one reflective or transflective outer major surface 1610 includes at least one major surface of the at least one transparent optical object 1629.

Light path 1650 starts at light source 1625, which is disposed to inject light through the light injection region (input surface 1623), and extends through output major surface 1620. Light path 1650 includes two reflections from the at least one reflective or transflective outer major surface 1610 and includes two passes through switchable diffuser 1630. Light path 1650 is transmitted through switchable diffuser 1630 substantially without scattering. This can occur when the switchable diffuser is in a first state which may be a substantially clear state (i.e., the first state may have a first haze that is substantially zero). First segment 1651 starts at light source 1625 and ends at the first reflection of light path 1650 from the at least one reflective or transflective outer major surface 1610.

Light path 1655*a* includes first segment 1651, but is scattered as it passes through switchable diffuser 1630 and reflects twice more from the at least one reflective or transflective outer major surface 1610 and then exits optical volume 1626 through output major surface 1620. Light path 1655*a* may occur when the switchable diffuser is in a second state which may have a second haze higher that the first haze. Light path 1655*b* includes first segment 1651, but is scattered as it passes through switchable diffuser 1630 and exits optical volume 1626 through output major surface 1620 without further reflections from the at least one reflective or transflective outer major surface 1610. Light path 1655*b* may occur when the switchable diffuser is in a third state which may have a third haze higher that the second haze.

Light paths 1650, 1655*a* and 1655*b* start from light source 1625, pass through input surface 1623, and extend through output major surface 1620. Light paths 1650, 1655*a* and 1655*b* do not include any reflections from output major surface 1620, do not include any portions or segments that pass into optical volume 1626 through output major surface 1620 from a region outside optical volume 1626, do not include Fresnel surface reflections from switchable diffuser 1630 and do not include backscattering from switchable diffuser 1630.

Light path 1650 includes a first number (two) of reflections from the at least one reflective or transflective outer major surface 1610, light path 1655*a* includes a second number (three) of reflections from the at least one reflective or transflective outer major surface 1610, and light path

1655*b* includes a third number (one) of reflections from the at least one reflective or transflective outer major surface 1610.

Switchable diffuser 1630 may include a plurality of independently addressable regions. As described elsewhere, this may allow an improved degree of adjustability of the light output distribution. Switchable diffuser 1630 may have a surface normal that is not parallel to an optical axis of optical volume 1626. Switchable diffuser 1630 may have a surface normal that is orthogonal or substantially orthogonal to an optical axis of optical volume 1626. The optical axis of optical volume 1626 may be parallel to a direction of average light output when the switchable diffuser 1630 is in a substantially clear state.

In some embodiments, the switchable diffuser 1630 may not extend through the length of the optical volume 1626 and/or may not be substantially centered in the optical volume 1626. An example of such an embodiment is illustrated in FIG. 17.

Figure 17:
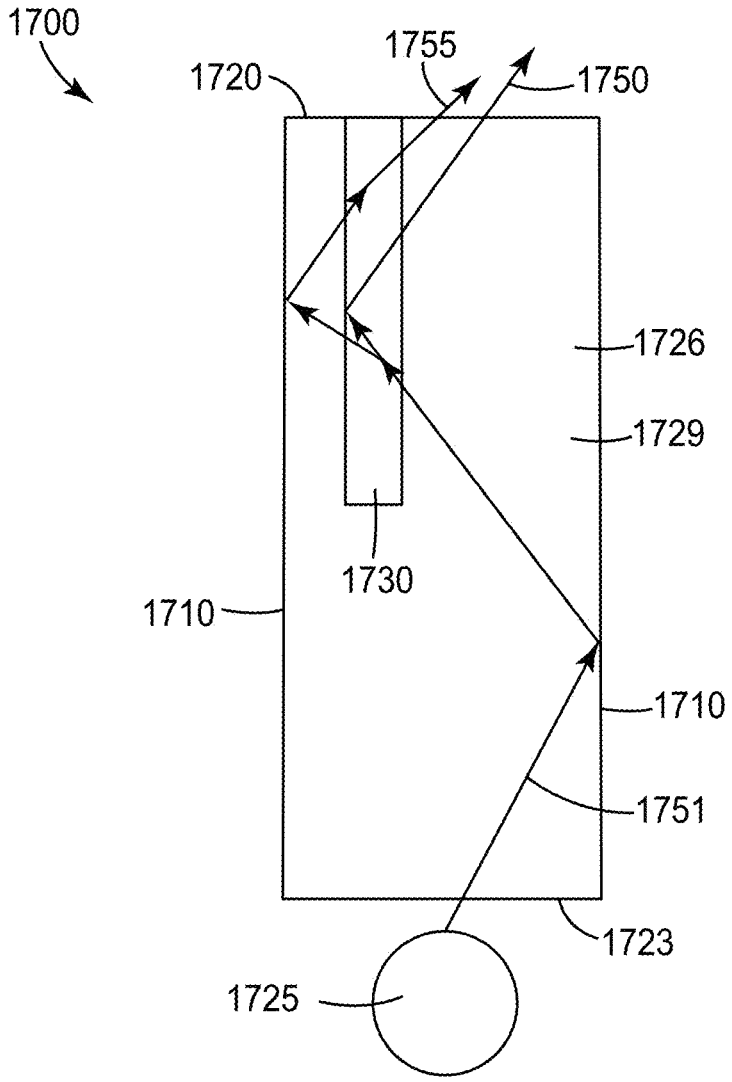

FIG. 17 shows a cross-sectional view of lighting component 1700 including at least one reflective or transflective outer major surface 1710, output major surface 1720, input surface 1723 which is a light injection region for lighting component 1700, light source 1725, optical volume 1726, transparent optical object 1729, switchable diffuser 1730, light path 1750 having first segment 1751, and light path 1755 which also includes first segment 1751. In some embodiment, lighting component 1700 may have a substantially cylindrical or axially symmetric shape analogous to lighting component 1400B. In some embodiments, lighting component 1700 may have a substantially rectangular parallelepiped shape analogous to lighting component 1400C. Switchable diffuser 1730 may be disposed in a hollowed-out region of transparent optical object 1729 which may be a single optical solid or may include a plurality of optical solids attached together and attached to switchable diffuser 1730 through one or more optically clear adhesives which may be index matched to the optical solids.

Light path 1750 includes first segment 1751 from light source 1725 to the at least one reflective or transflective outer major surface 1710. Light path 1750 reflects from the at least one reflective or transflective outer major surface 1710, passes through switchable diffuser 1730, reflects from a surface of switchable diffuser 1730, passes back through switchable diffuser and then exits lighting component 1700 through output major surface 1720. Light path 1750 includes two passes through switchable diffuser 1730. Light path 1750 is substantially unscattered as it passes through switchable diffuser 1730. This may occur when the switchable diffuser being in a first state which may be a substantially clear state. Light path 1755 also includes first segment 1751 and is also reflected towards switchable diffuser 1730 from the at least one reflective or transflective outer major surface 1710. Light path 1755 scatters as it passes though switchable diffuser 1730 and includes a second reflection from the at least one reflective or transflective outer major surface 1710, includes a second pass through switchable diffuser 1730 where it scatters again, and then light path 1755 exits lighting component 1700 through output major surface 1720. Light paths 1750 and 1755 do not include any reflections from output major surface 1720, do not include any portions or segments that pass into optical volume 1726 through output major surface 1720 from a region outside optical volume 1726, and do not include backscattering from switchable diffuser 1730.

Switchable diffuser 1730 may include a plurality of independently addressable regions. As described elsewhere, this may allow an improved degree of adjustability of the light output distribution. Switchable diffuser 1730 may have a surface normal that is not parallel to an optical axis of optical volume 1726. Switchable diffuser 1730 may have a surface normal that is orthogonal, or substantially orthogonal, or at a skew angle to an optical axis of optical volume 1726. The optical axis of optical volume 1726 may be parallel to a direction of average light output when the switchable diffuser is in a substantially clear state.

Any of the embodiments illustrate in FIGS. 14A-17 may further include additional reflective or transflective layers adjacent the at least one reflective or transflective outer major surface of the optical volume. The lighting component without the addition reflective or transflective layer may be understood have a first optical volume and the addition of the additional reflective or transflective layers may be understood to define a second optical volume that includes the first optical volume and includes an additional volume between the first optical volume and the outer surface of the additional reflective or transflective layers. An example of such an embodiment is illustrated in FIG. 18.

Figure 18:
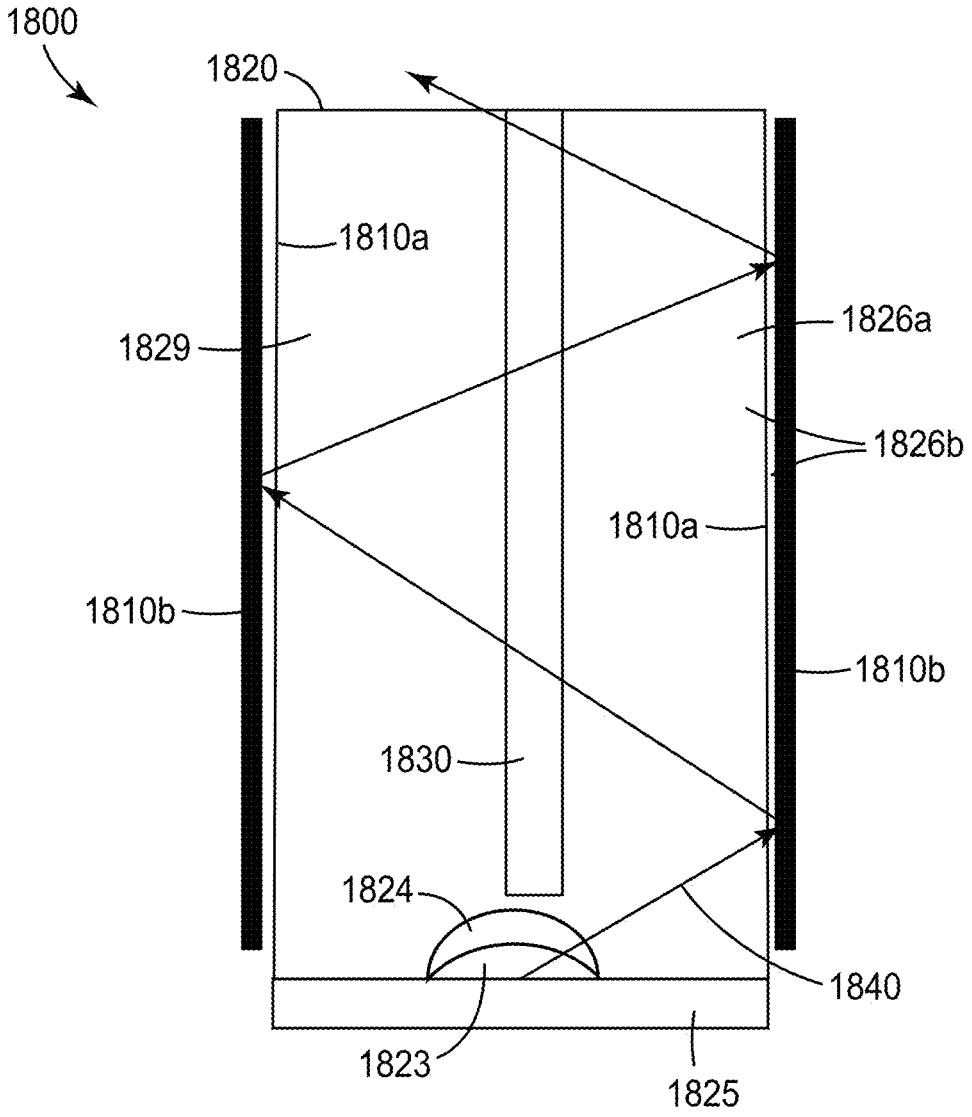

FIG. 18 shows a cross-sectional view of lighting component 1800 including at least one reflective or transflective outer major surface 1810*a*, output major surface 1820, light injection region 1823, lens 1824, light source 1825, optical volume 1826*a*, transparent optical object 1829, switchable diffuser 1830, at least one additional reflective or transflective layer 1810*b*, optical volume 1826*b* which includes optical volume 1826*a* and includes a space between the at least one reflective or transflective outer major surface 1810*a* and the at least one additional reflective or transflective layer 1810*b*. The space may be an air gap or may be filled with an optically clear adhesive. Lighting component 1800 may have any geometry and may have a substantially cylindrically symmetric or axially symmetric geometry as described elsewhere or may have a substantially wedge geometry or a substantially rectangular parallelepiped geometry as described elsewhere. Switchable diffuser 1830 may be disposed at or near the center of optical volume 1826*a* or may be off-center. The at least one additional reflective or transflective layer 1810*b* may be included so that light incident on the at least one reflective or transflective outer major surface 1810*a* at an angle of incidence below the critical angle for TIR may be transmitted through the at least one reflective or transflective outer major surface 1810*a* and then reflected from the at least one additional reflective or transflective layer 1810*b* back into optical volume 1826*a*.

Light path 1840 starts at light injection region 1823 and exits lighting component 1800 through output major surface 1820. Light path 1840 includes three passes through switchable diffuser 1830.

Switchable diffuser 1830 may include a plurality of independently addressable regions. The at least one additional reflective or transflective layer 1810*b* may have spatially varying reflective and/or transmissive properties as described elsewhere. Differing distinct reflectance and/or transmittance properties can be achieved by using various MOF films, for example, as described elsewhere. The at least one additional reflective or transflective layer 1810*b* may have a plurality of zones with differing reflective or transmissive properties as described elsewhere. The zones may be in correspondence with independently addressable regions of the switchable diffuser 1830. By suitably selecting the reflective and/or transmissive properties of the at least one additional reflective or transflective layer 1810*b*, the light output from lighting component 1800 may have differing output angular distributions, differing output spectral distributions (i.e., differing color output) or a combination thereof, when switchable diffuser 1830 is changed from a first state to a second state differing from the first state.

Figure 19A:
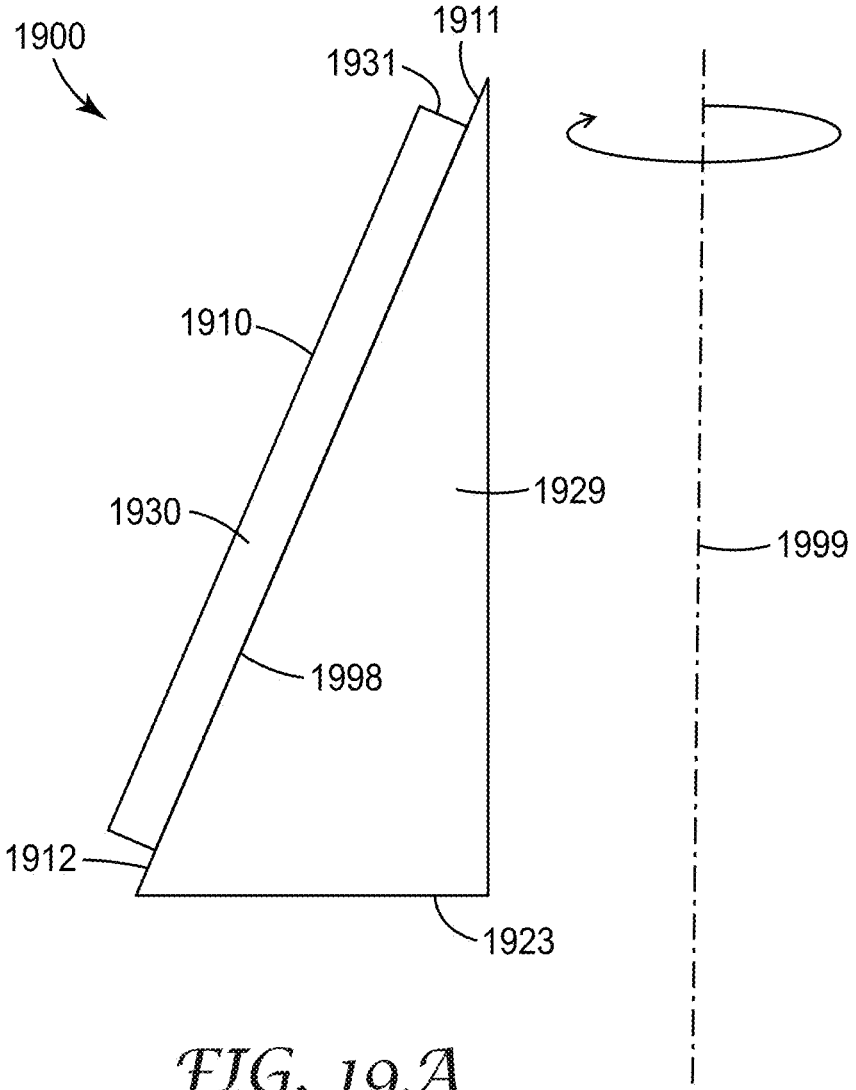
FIG. 19A is a schematic illustration of a lighting component.
Figure 19B:
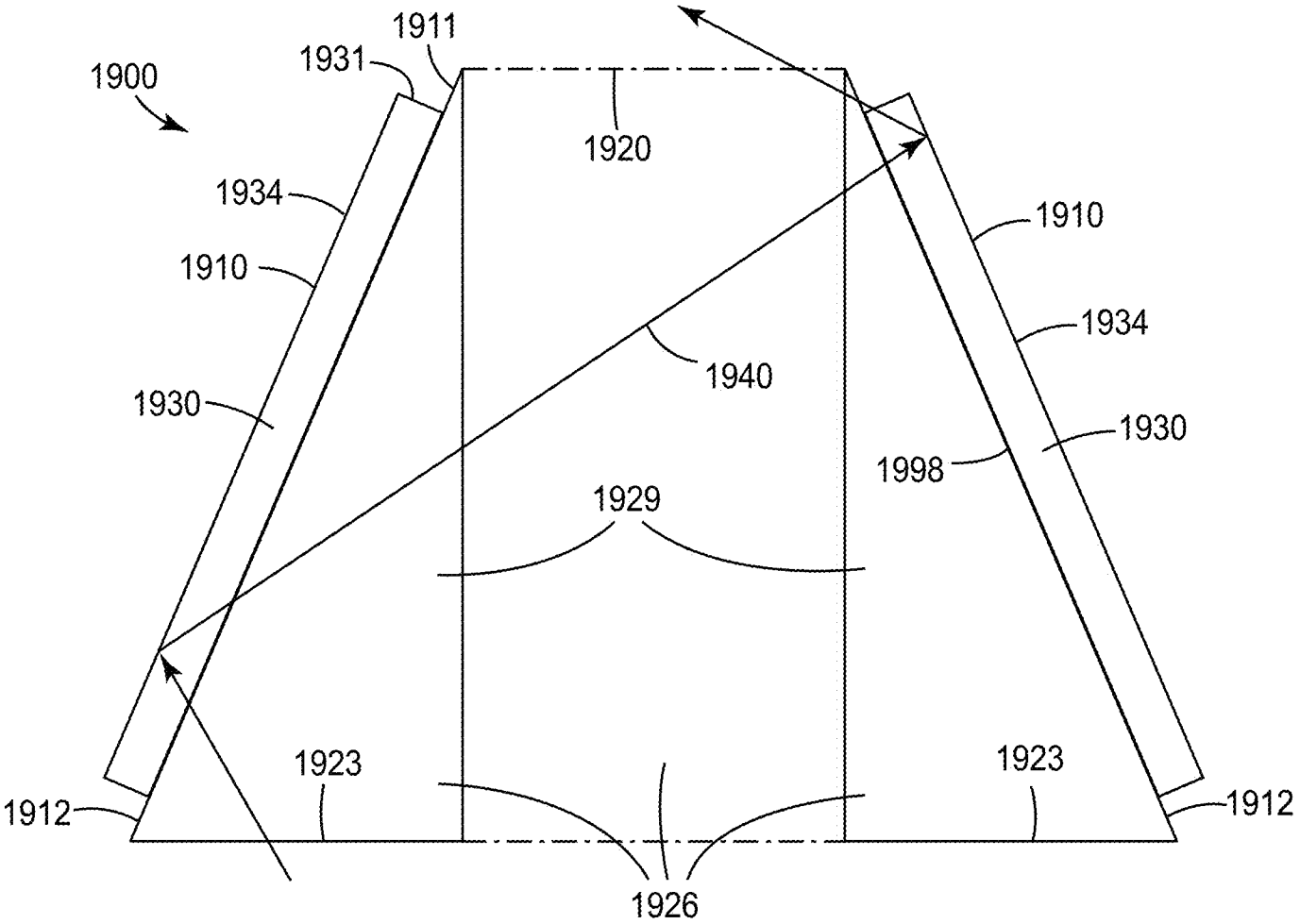
FIG. 19B is a cross-sectional view of the lighting component of FIG. 19A.
Figure 19C:
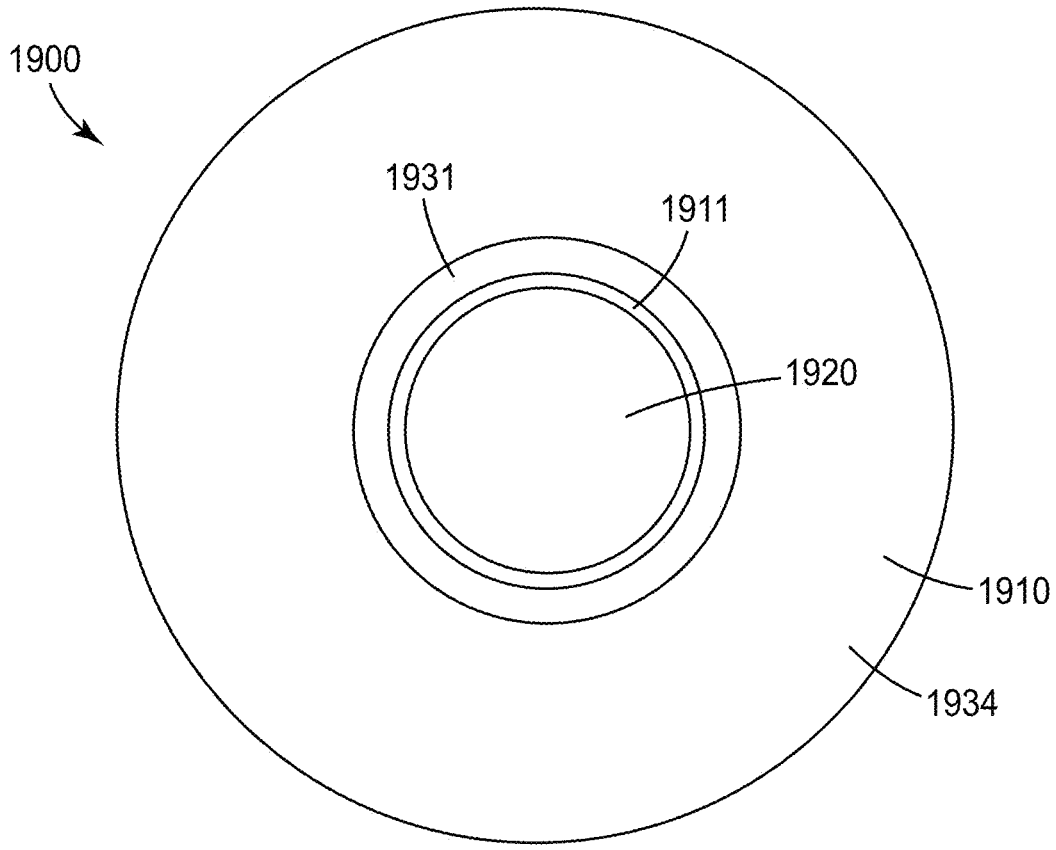
FIG. 19C is a top view of the lighting component of FIG. 19A.

FIGS. 19A-19C shows lighting component 1900 including reflective or transflective outer major surface 1910, optional additional surfaces 1911 and 1912, distal surface 1920 which may be an output major surface, input surface 1923 which is a light injection region for lighting component 1900, optical volume 1926, transparent optical object 1929, switchable diffuser 1930 having an edge 1931 and outer major surface 1934, and light path 1940. Transparent optical object 1929 includes outer surface 1998. The geometry of lighting component 1900 can be described in terms of an object of revolution about axis 1999 as illustrated in FIG. 19A. Axis 1999 may be an optical axis of optical volume 1926 and may be parallel to a direction of average light output of the optical volume when the switchable diffuser 1930 is in the first state. Distal surface 1920 is orthogonal to axis 1999. A cross-sectional view of lighting component 1900 is provided in FIG. 19B, and a top view of lighting component 1900 is provided in FIG. 19C. When the switchable diffuser 1930 is in a first state, which may be a substantially clear state, the light output from lighting component 1900 may be axially symmetric.

Lighting component 1900 may include optional additional surfaces 1911 and/or 1912 which may be portions of an outer surface 1998 of transparent optical object 1929 that is not covered by switchable diffuser 1930. In some cases, the optional additional surfaces 1911 and/or 1912 are major surfaces which are reflective or transflective. In such cases, the reflective or transflective outer major surface 1910 may include the optional additional surfaces 1911 and/or 1912. In some embodiments, switchable diffuser 1930 covers or substantially covers the outer surface 1998 of transparent optical object 1929. In such embodiments, optional additional surfaces 1411 and/or 1412 may be absent.

A light source may be disposed adjacent input surface 1923. The light source may include a plurality of LEDs arranged in a circle and facing input surface 1923 or may include other circular light sources such as a compact fluorescent circular light bulb or may include a circular light guide configured to produce a circular or approximately circular output from a non-circular light input. Alternatively, the light source may purposely be non-circular to produce a desired output distribution which may not be circularly or axially symmetric.

Light path 1940 (see FIG. 19B) passes through input surface 1923, passes through switchable diffuser 1930, reflects from reflective or transflective outer major surface 1910, passes back through the switchable diffuser, passes through and exits transparent optical object 1929, passes back into and through transparent optical object 1929, passes again through switchable diffuser 1930, reflects again from reflective or transflective outer major surface 1910, exits switchable diffuser 1930 through edge 1931, passes back though transparent optical object 1929, and exits optical volume 1926 through distal surface 1920.

Switchable diffuser 1930 may include a plurality of independently addressable regions. An additional reflective or transflective layer may be included outside of switchable diffuser 1930, analogously to lighting component 1800 described elsewhere. The additional reflective or transflective layer may have spatially varying reflective and/or transmissive properties and may have zones with differing reflective and/or transmissive properties as described elsewhere. The zones may be in correspondence with independently addressable regions of switchable diffuser 1930. The light output from lighting component 1900 may have differing output angular distributions, differing output spectral distributions (i.e., differing color output) or a combination thereof, when switchable diffuser 1930 is changed from a first state to a second state differing from the first state.

Lighting component 1900 has an axial symmetry. Alternative lighting components can be obtained similarly to lighting component 1900 but with a modified geometry. For example, a top view of an alternate lighting component may be oval or square or rectangular instead of circular as shown in FIG. 19C.

Figure 20:
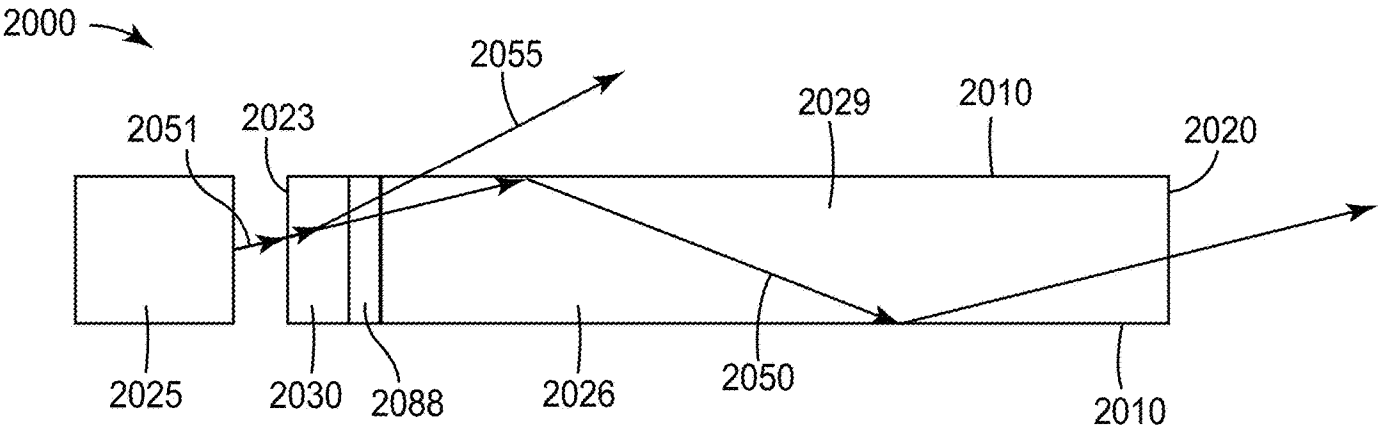
FIG. 20 is a cross-sectional view of a lighting component.

FIG. 20 shows a cross-sectional view of lighting component 2000 including at least one reflective or transflective outer major surface 2010, output major surface 2020, input surface 2023, light source 2025, optical volume 2026, transparent optical object 2029, switchable diffuser 2030, light path 2050 including first segment 2051, light path 2055 also including first segment 2051, and optional optically clear adhesive 2088.

Light path 2050 includes first segment 2051, reflects twice by TIR from the at least one reflective or transflective outer major surface 2010, and exits optical volume 2026 through output major surface 2020. Light path 2050 is substantially unscattered by switchable diffuser 2030 which may correspond to the switchable diffuser being in a first state which may be a substantially clear state. Light path 2055 includes first segment 2051, scatters as it passes through switchable diffuser 2030, and exits optical volume 2026 through the at least one reflective or transflective outer major surface 2010. Light path 2055 may correspond with the switchable diffuser being in a hazy state. The state of switchable diffuser 2030 may be adjusted to control the distribution of light entering transparent optical object 2029 such that a hazy state directs more light at angles such that TIR is defeated and a broader angular output distribution is obtained. In some embodiments, switchable diffuser 230 is disposed between light source 2025 and transparent optical object 2029 such that when the switchable diffuser is in a hazy state at portion of light from the light source is diffused such that it does not enter transparent optical object 2029.

Transparent optical object 2029 may be an optically clear solid. In some embodiments, transparent optical object 2029 has a cylindrical or axially symmetric geometry. In such embodiments, the at least one reflective or transflective outer major surface 2010 may be a single surface. In some embodiments, transparent optical object 2029 has a substantially parallelepiped (e.g., cuboid or rectangular parallelepiped) geometry. In such embodiments, the at least one reflective or transflective outer major surface 2010 may be two opposing surfaces. Optical volume 2026 may be considered to be the volume of transparent optical object 2029 plus the volume of optically clear adhesive 2088 plus the volume of switchable diffuser 2030.

In some embodiments, transparent optical object 2029 is a monolithic solid light guide. In other embodiments, transparent optical object 2029 is replaced with a hollow light guide providing the at least one reflective or transflective outer major surface 2010. In some embodiments, the hollow light guide may be formed from a film that provides TIR or may be formed from an MOF film which may be perforated.

Light source 2025 may include optical elements that control the distribution of light input into switchable diffuser 2030. For example, light source 2025 may include refractive elements or collimating lenses. In some embodiments, a refractive element is included adjacent switchable diffuser 2030 opposite optically clear adhesive 2088. The refractive element may be included so that input light has an angular distribution suitable for TIR from the at least one reflective or transflective outer major surface 2010. The refractive element may be attached to the switchable diffuser 2030 with an optically clear adhesive.

Switchable diffuser 2030 may include a plurality of independently addressable regions. An additional reflective or transflective layer may be included outside of the at least one reflective or transflective outer major surface 2010, analogously to lighting component 1800 described elsewhere. The additional reflective or transflective layer may have spatially varying reflective and/or transmissive properties (e.g., zones with differing reflective properties) as described elsewhere. The light output from lighting component 2000 may have differing output angular distributions, differing output spectral distributions (i.e., differing color output), differing polarization output distributions, or a combination thereof, when switchable diffuser 2030 is changed from a first state to a second state differing from the first state.

Light source 2025 may be disposed adjacent switchable diffuser 2030 with an air gap separating light source 2025 and switchable diffuser 2030. Alternatively, light source 2025 may be attached to switchable diffuser 2030 with an optically clear adhesive, which may be a low-index adhesive. In some embodiments, optional optically clear adhesive 2088 is not included and an air gap separates switchable diffuser 2030 from transparent optical object 2029.

Any of the optically clear adhesives used in any of the lighting components of the present description may be low-index adhesives. Suitable low-index optically clear adhesives include Norland Optical Adhesives 1315, 132, 138, 142, and 144 having refractive indices quoted by the manufacturer ranging from 1.315 to 1.44 (available from Norland Products, Cranbury, N.J.). In some embodiments, the low-index adhesive is an ultra low-index (ULI) material having a refractive index less than about 1.3 or less than about 1.2 or even less than about 1.15. Suitable ULI materials include nanovoided materials such as those described in U.S. Pat. Appl. Pub. No. 2012/0038990 (Hao et al.).

In some embodiments, transparent optical object 2029 is a tapered light guide which may be hollow or may be solid. The light guide may be tapered such that the opposing boundaries of the light guide substantially converge from the input surface to the output surface. For example, the light guide may have the shape of optical volume 1526 of FIG. 15.

The embodiments described herein illustrate how an optical volume can be defined by at least one reflective or transflective outer major surface and/or a transparent optical object of a lighting component. In some embodiments, an optical volume of a lighting component may be defined in terms of at least one reflective or transflective surface as the smallest convex volume containing the at least one reflective or transflective surface (i.e., the convex hull of the at least one reflective or transflective surface). In some embodiments, the distal surface of the optical volume, which may be an output major surface, may be defined as a surface of the smallest convex volume that is adjacent the one or more edges of the at least one reflective or transflective outer major surface distal from a light injection region of the optical volume. Similarly, in some embodiments, an input surface may be defined as a surface of the smallest convex volume adjacent the one or more edges of the at least one reflective or transflective outer major surface proximal to a light injection region of the optical volume. For example, optical volume 1126 of lighting component 1100 may be the convex hull of the at least one reflective or transflective outer major surface 1110, and distal surface 1120 and input surface 1123 may be surfaces of the convex hull adjacent the at least one distal edge 1113 and adjacent the at least one proximal edge 1116, respectively.

In some embodiments, an input surface may be defined as a planar surface adjacent to and at least partially bounded by the one or more proximal edges of the at least one reflective or transflective surface. Similarly, in some embodiments, a distal surface, which may be an output major surface, may be defined as a planar surface adjacent to and at least partially bounded by the one or more distal edges of the at least one reflective or transflective surface. In some embodiments, the optical volume may then be defined as a volume at least partially bound by the input surface, the distal surface, and the at least one reflective or transflective surface. When a surface is partially but not completely bound by one or more edges, a boundary of the surface may be defined as the one or more edges plus linear segments extending between the one or more edges in the regions where the surface is not bounded by the one or more edges. Similarly when a volume is not completely bound by one or more surfaces, a boundary of the volume may be defined as the one of more surfaces plus segments extending between the one or more surfaces in the regions where the volume is not bounded by the one or more surfaces. The segments may be minimal areas that extend between the one or more surface. For example, the one or more segments 1167 of lighting component 1100 may be planar or conical areas.

In some embodiments, the optical volume may be filed with an optically clear material. In such embodiments, the optical volume may be the volume of the optically clear material or the volume of the optically clear material plus the volume of one or more switchable diffusers disposed adjacent the optically clear material. The input surface may be a surface of the optically clear material and the distal surface of the optical volume, which may be an output major surface, may be a surface of the optically clear material.

In some embodiments, a system that one or more of the lighting components described herein is provided. The system or individual lighting components may include at least one sensor and a controller. The sensor may be included in or adjacent to an individual lighting component or may be spatially separate from any lighting components. The sensor may be a light sensor which detects when the lighting in a room or a portion of a room is too dim or too bright and may provide a signal to the controller that includes such information. In some embodiments, the sensor may be a proximity sensor that detects when someone is in a room or a section of a room or may detect the number of people in a room or a section of the room. The controller may receive information from the at least one sensor and determine an appropriate state of switchable diffuser(s) in the lighting component(s). The controller may then send a control signal to one or more switchable diffusers in one or more lighting components if it determines that a state change is needed. The controller may also control the light source or light sources of one or more lighting components in response to signals received by the one or more sensors. In some embodiments, the controller may alter the output level of a light source as the state of the corresponding switchable diffuser is changed. This may be useful for masking optical effects associated with the state change. For example, the controller may dim or lower the output level of the light source as the switchable diffuser is switched from a clear state to a hazy state and then subsequently change the output level of the light source back to its level prior to the state change or to a different level.

Figure 21:
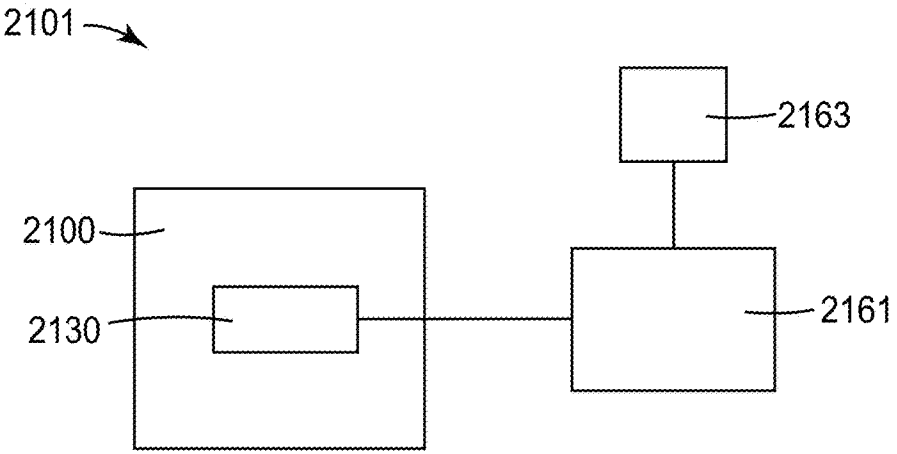
FIG. 21 is a schematic illustration of a system including a lighting component, a controller, and a sensor.

FIG. 21 schematically illustrates system 2101 including lighting component 2100 that includes switchable diffuser 2130. Switchable diffuser 2130 is connected to controller 2161 which is connected to sensor 2163. The connection between the switchable diffuser 2130 and controller 2161 may be a wired connector or a wireless connection. Similarly, the connection between controller 2161 and sensor 2163 may be wired or wireless. In the illustrated embodiment, one lighting component and one sensor are provided. In other embodiments, multiple lighting components and/or multiple sensors are provided. In the illustrated embodiment, the sensor 2163 is separate from the lighting component 2100. In other embodiments, sensor 2163 may be disposed adjacent to, within, or partially within lighting component 2100.

The following is a list of exemplary embodiments of the present description:

Item 1 is a lighting component comprising:

an optical volume including a light injection region, at least one reflective or transflective outer major surface, and an output major surface, the output major surface adjacent one or more distal edges of the at least one reflective or transflective outer major surface; and a first switchable diffuser disposed at least partially within the optical volume, the first switchable diffuser having at least a first state and a second state, the first state characterized by a first haze and the second state characterized by a second haze different from the first haze, wherein at least a portion of the first switchable diffuser has a surface normal that is not parallel to an optical axis of the optical volume; and wherein the at least one reflective or transflective outer major surface defines opposing boundaries of the optical volume.

Item 2 is a lighting component comprising:

an optical volume including a light injection region, at least one reflective or transflective outer major surface, and an output major surface, the output major surface adjacent one or more distal edges of the at least one reflective or transflective outer major surface; and a first switchable diffuser disposed at least partially within the optical volume, the first switchable diffuser having at least a first state and a second state, the first state characterized by a first haze and the second state characterized by a second haze different from the first haze, wherein the at least one reflective or transflective outer major surface has a spatially varying reflective property; and wherein the at least one reflective or transflective outer major surface defines opposing boundaries of the optical volume.

Item 3 is the lighting component of item 2, wherein the spatially varying reflective property includes one or more of reflectivity of unpolarized light in a first wavelength band, reflectivity of polarized light having a first polarization state in the first wavelength band, degree of diffuse reflectivity of unpolarized light in the first wavelength band, and degree of diffuse reflectivity of polarized light having the first polarization state in the first wavelength band.

Item 4 is a lighting component comprising:

an optical volume including a light injection region, at least one reflective or transflective outer major surface, and an output major surface, the output major surface adjacent one or more distal edges of the at least one reflective or transflective outer major surface; and a first switchable diffuser disposed at least partially within the optical volume, the first switchable diffuser having at least a first state and a second state, the first state characterized by a first haze and the second state characterized by a second haze different from the first haze, wherein the at least one reflective or transflective outer major surface defines opposing boundaries of the optical volume, and wherein the at least one reflective or transflective outer major surface includes one or more surfaces extending from the light injection region to the output major surface, and includes an additional surface disposed proximate the output major surface opposite the light injection region.

Item 5 is the lighting component of any of items 1-4, wherein the first switchable diffuser has a curved shape.

Item 6 is the lighting component of any of items 1-4, wherein the first switchable diffuser has a substantially flat shape.

Item 7 is the lighting component of any of items 1-4, wherein the at least one reflective or transflective outer major surface includes at least one curved portion.

Item 8 is the lighting component of any of items 1-4, wherein the at least one reflective or transflective outer major surface includes at least one flat portion.

Item 9 is the lighting component of any of items 1-4, wherein the at least one reflective or transflective outer major surface includes two or more planar surfaces not all in a common plane.

Item 10 is the lighting component of any of items 1-4, wherein the first state is a substantially clear state.

Item 11 is the lighting component of any of items 1-4, wherein, except for the first switchable diffuser, optional additional diffusers, and optional optical elements in the light injection region, the optical volume is substantially hollow or substantially monolithic.

Item 12 is the lighting component of any of items 1-4, wherein the light injection region is an input surface of the optical volume opposite the output major surface.

Item 13 is the lighting component of any of items 1-4, wherein the optical volume has boundaries which substantially converge or diverge but not both from the light injection region to the output major surface.

Item 14 is the lighting component of any of items 1-4, wherein the first switchable diffuser is disposed substantially entirely within the optical volume.

Item 15 is the lighting component of any of items 1-4, further comprising a second switchable diffuser disposed at least partially within the optical volume.

Item 16 is the lighting component of any of items 1-4, wherein the first switchable diffuser has a third state different from the first state and different from the second state.

Item 17 is the lighting component of any of items 1-4, wherein the first switchable diffuser includes smectic A liquid crystal.

Item 18 is the lighting component of any of items 1-4, wherein the output major surface is substantially orthogonal to a direction of average light output of the optical volume when the first switchable diffuser is in the first state.

Item 19 is the lighting component of any of items 1-4, wherein the first switchable diffuser includes a plurality of independently addressable regions, each region independently capable of being in the first state or in the second state.

Item 20 is the lighting component of item 19, wherein the at least one reflective or transflective outer major surface includes a plurality of zones having a reflective property that varies from zone to zone.

Item 21 is the lighting component of item 20, wherein the zones are in correspondence with the regions.

Item 22 is the lighting component of item 20, wherein the reflective property includes one or more of reflectivity of unpolarized light in a wavelength band, reflectivity of polarized light having a first polarization state in the wavelength band, degree of diffuse reflectivity of unpolarized light in the wavelength band, and degree of diffuse reflectivity of polarized light having the first polarization state in the wavelength band.

Item 23 is the lighting component of item 19, further comprising a light source having a plurality of LEDs.

Item 24 is the lighting component of item 23, wherein the independently addressable regions of the first switchable diffuser are registered with the plurality of LEDs.

Item 25 is the lighting component of item 19, further comprising a segmented layer adjacent the first switchable diffuser, wherein segments of the segmented layer are registered with the independently addressable regions of the first switchable diffuser.

Item 26 is the lighting component of any of items 1-4 further comprising a non-switchable diffuser disposed at least partially within the optical volume.

Item 27 is the lighting component of item 26, wherein the non-switchable diffuser is adjacent the first switchable diffuser.

Item 28 is the lighting component of any of items 1-4, wherein when a light is injected into the light injection region and the first switchable diffuser is in the first state, a first light output is produced, and when the light is injected into the light injection region and the first switchable diffuser is in the second state, a second light output is produced, and wherein the first light output and the second light output have differing output angular distributions, differing output spectral distributions, differing output polarization distributions, or a combination thereof.

Item 29 is the lighting component of any of items 1-3, wherein the at least one reflective or transflective outer major surface includes a first axially symmetric surface extending from the light injection region to the output major surface.

Item 30 is the lighting component of item 29, wherein the at least one reflective or transflective outer major surface includes a second axially symmetric surface physically separate from the first axially symmetric surface and disposed adjacent the output major surface opposite the light injection region.

Item 31 is the lighting component any of items 1-3, wherein the at least one reflective or transflective outer major surface includes a first surface that extends from the light injection region to the output major surface and an opposing second surface that extends from the light injection region to the output major surface, and further includes a third surface disposed adjacent the output major surface opposite the light injection region.

Item 32 is the lighting component of item 4, wherein the one or more surfaces includes a first axially symmetric surface extending from the light injection region to the output major surface.

Item 33 is the lighting component of item 32, wherein the additional surface includes a second axially symmetric surface physically separate from the first axially symmetric surface and disposed adjacent the output major surface opposite the light injection region.

Item 34 is the lighting component of item 4, wherein the one or more surfaces includes a first surface that extends from the light injection region to the output major surface and an opposing second surface that extends from the light injection region to the output major surface.

Item 35 is a lighting component comprising:

a monolithic optically clear component having at least one sloping major surface, an input surface adjacent the at least one sloping major surface, and an output surface opposite the input surface, the output surface adjacent the at least one sloping major surface;

at least one diffuser attached to and covering at least a portion of at least one sloping major surface;

wherein the at least one diffuser includes a first switchable diffuser having at least a first state and a second state different from the first state; and wherein the at least one sloping major surface substantially converges or diverges but not both from the input surface to the output surface.

Item 36 is the lighting component of item 35, wherein the at least one sloping major surface includes a first sloping major surface and an opposing second sloping major surface, wherein the first switchable diffuser is attached to and covers at least a portion of the first sloping major surface.

Item 37 is the lighting component of item 36, wherein the at least one diffuser includes a second switchable diffuser attached to and covering at least a portion of the second sloping major surface.

Item 38 is the lighting component of item 35, wherein the at least one sloping major surface is a continuous surface encircling a cross-section of the monolithic optically clear component.

Item 39 is the lighting component of item 38, wherein the first switchable diffuser substantially covers the continuous surface.

Item 40 is a lighting component comprising:

a light guide having at least one major surface, an input surface adjacent the at least one major surface, and an output surface opposite the input surface, the output surface adjacent the at least one major surface;

a first switchable diffuser disposed adjacent the input surface opposite the output surface;

wherein the first switchable diffuser has at least a first state and a second state different from the first state.

Item 41 is the lighting component of item 40, wherein the first switchable diffuser is attached to the input surface through an optically clear adhesive.

Item 42 is the lighting component of item 40, wherein an air gap separates the first switchable diffuser and the input surface.

Item 43 is the lighting component of item 40 further comprising a light source disposed adjacent the first switchable diffuser opposite the input surface.

Item 44 is the lighting component of item 40, wherein the at least one major surface includes opposing boundaries that substantially converge from the input surface to the output surface.

Item 45 is a lighting component comprising:

an optical volume having at least one reflective or transflective outer major surface, a light injection region adjacent the at least one reflective or transflective outer major surface, and a distal surface opposite the light injection region; and a first switchable diffuser disposed at least partially within the optical volume, the first switchable diffuser having at least a first state and a second state, the first state characterized by a first haze and the second state characterized by a second haze different from the first haze, wherein the at least one reflective or transflective outer major surface defines opposing boundaries of the optical volume, wherein the opposing boundaries substantially converge from the light injection region to the distal surface.

Item 46 is the lighting component of any of items 1-4 and 35-45 further comprising at least one sensor and a controller, wherein the controller is configured to receive at least one input from the at least one sensor and to provide a control signal to the first switchable diffuser.

Item 47 is a system comprising a plurality of the lighting components of any of items 1-4 and 35-45.

Item 48 is the system of item 47 further comprising at least one sensor and a controller, wherein the controller is configured to receive at least one input from the at least one sensor and to provide a control signal to the first switchable diffuser of each of the plurality of the lighting components.

Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A lighting component comprising: an optical volume including a light injection region, at least one reflective or transflective outer major surface defined by a film reflecting at least 10 percent of a light energy incident on the at least one reflective or transflective outer major surface, and an output major surface, the output major surface adjacent one or more distal edges of the at least one reflective or transflective outer major surface; and a first switchable diffuser disposed at least partially within the optical volume, the first switchable diffuser having at least a first state and a second state, the first state characterized by a first haze and the second state characterized by a second haze different from the first haze, wherein at least a portion of the first switchable diffuser has a surface normal that is not parallel to an optical axis of the optical volume; and wherein the at least one reflective or transflective outer major surface defines opposing boundaries of the optical volume, wherein the first switchable diffuser includes a plurality of independently addressable regions, each region independently capable of being in the first state or in the second state; and wherein the at least one reflective or transflective outer major surface includes a plurality of zones having a reflective property that varies discretely from zone to zone by spatial variation in a perforation density of the film, the zones being in one-to-one correspondence with the regions such that when each region is in the first state and for each zone, light injected into the light injection region is incident on the zone after being transmitted through a region of the first switchable diffuser corresponding to the zone.

2. The lighting component of claim 1, wherein the optical volume has boundaries which substantially converge or diverge but not both from the light injection region to the output major surface.

3. The lighting component of claim 1, wherein the first switchable diffuser includes smectic A liquid crystal.

4. The lighting component of claim 1, further comprising a light source having a plurality of LEDs, wherein the independently addressable regions of the first switchable diffuser are registered with the plurality of LEDs.

5. The lighting component of claim 1, further comprising a segmented layer adjacent the first switchable diffuser, wherein segments of the segmented layer are registered with the independently addressable regions of the first switchable diffuser.

6. The lighting component of claim 1 further comprising at least one sensor and a controller, wherein the controller is configured to receive at least one input from the at least one sensor and to provide a control signal to the first switchable diffuser.

7. The lighting component of claim 1, wherein the at least one reflective or transflective outer major surface includes a first axially symmetric surface extending from the light injection region to the output major surface and includes a second axially symmetric surface physically separate from the first axially symmetric surface and disposed adjacent the output major surface opposite the light injection region.

8. The lighting component of claim 1, wherein each surface in the at least one reflective or transflective outer major surface is a surface of a reflective or transflective film.

9. A lighting component comprising: an optical volume including a light injection region, at least one reflective or transflective outer major surface defined by a film reflecting at least 10 percent of a light energy incident on the at least one reflective or transflective outer major surface, and an output major surface, the output major surface adjacent one or more distal edges of the at least one reflective or transflective outer major surface; and a first switchable diffuser disposed at least partially within the optical volume, the first switchable diffuser having at least a first state and a second state, the first state characterized by a first haze and the second state characterized by a second haze different from the first haze, wherein the at least one reflective or transflective outer major surface defines opposing boundaries of the optical volume, wherein the first switchable diffuser includes a plurality of independently addressable regions, each region independently capable of being in the first state or in the second state; and wherein the at least one reflective or transflective outer major surface includes a plurality of zones having a reflective property that varies discretely from zone to zone by spatial variation in a perforation density of the film, the zones being in one-to-one correspondence with the regions such that when each region is in the first state and for each zone, light injected into the light injection region is incident on the zone after being transmitted through a region of the first switchable diffuser corresponding to the zone.

10. The lighting component of claim 9, wherein the reflective property includes one or more of reflectivity of unpolarized light in a first wavelength band, reflectivity of polarized light having a first polarization state in the first wavelength band, a ratio of diffuse to specular reflectivity of unpolarized light in the first wavelength band, and a ratio of diffuse to specular reflectivity of polarized light having the first polarization state in the first wavelength band.

11. The lighting component of claim 9 further comprising at least one sensor and a controller, wherein the controller is configured to receive at least one input from the at least one sensor and to provide a control signal to the first switchable diffuser.

12. A lighting component comprising: an optical volume having at least one reflective or transflective outer major surface defined by a film reflecting at least 10 percent of a light energy incident on the at least one reflective or transflective outer major surface, a light injection region adjacent the at least one reflective or transflective outer major surface, and a distal surface opposite the light injection region; and a first switchable diffuser disposed at least partially within the optical volume, the first switchable diffuser having at least a first state and a second state, the first state characterized by a first haze and the second state characterized by a second haze different from the first haze, wherein the at least one reflective or transflective outer major surface defines opposing boundaries of the optical volume, and wherein the opposing boundaries substantially converge from the light injection region to the distal surface, wherein the first switchable diffuser includes a plurality of independently addressable regions, each region independently capable of being in the first state or in the second state; and wherein the at least one reflective or transflective outer major surface includes a plurality of zones having a reflective property that varies discretely from zone to zone by spatial variation in a perforation density of the film, the zones being in one-to-one correspondence with the regions such that when each region is in the first state and for each zone, light injected into the light injection region is incident on the zone after being transmitted through a region of the first switchable diffuser corresponding to the zone.

13. The lighting component of claim 12 further comprising at least one sensor and a controller, wherein the controller is configured to receive at least one input from the at least one sensor and to provide a control signal to the first switchable diffuser.

* * * * *